US012594482B1

(12) United States Patent
Schwartz

(10) Patent No.: US 12,594,482 B1
(45) Date of Patent: Apr. 7, 2026

(54) METHOD AND SYSTEM FOR CENTRAL CONTROLLED ROWER SYNCHRONIZATION AND PERSONALIZED PERFORMANCE DATA COLLECTION

(71) Applicant: Sean Huang Schwartz, Ashburn, VA (US)

(72) Inventor: Sean Huang Schwartz, Ashburn, VA (US)

( * ) Notice: Subject to any disclaimer, the term of this patent is extended or adjusted under 35 U.S.C. 154(b) by 0 days.

(21) Appl. No.: 19/293,990

(22) Filed: Aug. 7, 2025

Related U.S. Application Data

(63) Continuation of application No. 19/025,023, filed on Jan. 16, 2025, now Pat. No. 12,409,377.

(51) Int. Cl.
*A63B 71/06* (2006.01)

(52) U.S. Cl.
CPC .. *A63B 71/0686* (2013.01); *A63B 2071/0688* (2013.01); *A63B 2220/62* (2013.01)

(58) Field of Classification Search
CPC ..... A63B 71/0686; A63B 2071/0688; A63B 2220/62
See application file for complete search history.

(56) References Cited

U.S. PATENT DOCUMENTS 4,984,986 A * 1/1991 Vohnout ..... A63B 69/06 73/379.06
6,980,118 B2 12/2005 Buvac
9,348,119 B2 * 5/2016 Thomson ..... H04N 23/698
10,252,134 B2 4/2019 Postelnik
10,376,735 B2 8/2019 Bates
10,471,297 B1 11/2019 Smith
10,712,394 B1 7/2020 Sperber
10,828,531 B1 11/2020 Smith
2005/0170711 A1 * 8/2005 Spencer ..... B63H 16/00 440/21
2005/0215870 A1 * 9/2005 Rademaker ..... A61B 5/02055 128/903

(Continued)

FOREIGN PATENT DOCUMENTS

GB 2542139 A 3/2017
WO 2013084230 A1 6/2013

(Continued)

OTHER PUBLICATIONS

CN 102114334 and translation (Year: 2013).
WO_2023049531 (Year: 2023).

*Primary Examiner* — Sundhara M Ganesan
(74) *Attorney, Agent, or Firm* — Venable LLP

(57) ABSTRACT

The present teaching relates to methods for synchronizing rowers in rowing. A synchronization timing instruction is generated based on a stroke rate as a stroke cycle with multiple timings for corresponding events to occur and used to facilitate synchronization across multiple rowers on the events in each stroke cycle based on the timings in the instruction. For each of the events and a timing specified in the instruction, an actual timing for the event related to each rower is received from a sensor and used to determine a synchronization status of the rower on the event in comparison with the timing for the event as provided by the instruction. The synchronization status on each event with respect to each rower is signaled to the rower.

17 Claims, 32 Drawing Sheets

(56) References Cited

U.S. PATENT DOCUMENTS

| | | | | |
|---|---|---|---|---|
| 2006/0116037 | A1* | 6/2006 | Squires | B63B 34/30 440/2 |
| 2007/0260483 | A1 | 11/2007 | Nurmela | |
| 2008/0200310 | A1 | 8/2008 | Tagliabue | |
| 2009/0153350 | A1 | 6/2009 | Steger | |
| 2013/0095711 | A1 | 4/2013 | Rubbo | |
| 2013/0142377 | A1 | 6/2013 | Walsh | |
| 2016/0263438 | A1 | 9/2016 | Donohoe | |
| 2017/0144047 | A1 | 5/2017 | Crawford | |
| 2017/0216706 | A1 | 8/2017 | Bleich | |
| 2017/0242405 | A1 | 8/2017 | Shirai | |
| 2018/0272218 | A1 | 9/2018 | Mattocks | |
| 2021/0016135 | A1 | 1/2021 | Lee | |
| 2024/0424372 | A1 | 12/2024 | Lee | |

FOREIGN PATENT DOCUMENTS

| | | | |
|---|---|---|---|
| WO | 2020028660 | A1 | 2/2020 |
| WO | 2023049531 | A1 | 3/2023 |

* cited by examiner

METHOD AND SYSTEM FOR CENTRAL CONTROLLED ROWER SYNCHRONIZATION AND PERSONALIZED PERFORMANCE DATA COLLECTION

CROSS REFERENCE TO RELATED APPLICATIONS

The present application is a continuation of U.S. application Ser. No. 19/025,023, now U.S. Pat. No. 12,409,377, filed on Jan. 16, 2025, entitled "SYSTEM AND METHOD FOR SYNCHRONIZED ROWING", which is related to U.S. patent application Ser. No. 1/295,930, filed on Aug. 7, 2025, entitled "A ROWER DEVICE FOR ROWING SYNCHRONIZATION VIA CONFIGURABLE SIGNALING AND PERSONALIZED SYNCHRONIZATION GUIDE", and U.S. patent application Ser. No. 19/025,132, now U.S. Pat. No. 12,403,357, filed on Jan. 16, 2025, entitled "SYSTEM AND METHOD FOR SENSING STROKE RELATED EVENTS FOR SYNCHRONIZATION ACROSS ROWERS", the contents of which are hereby incorporated by reference in their entireties.

BACKGROUND

1. Technical Field

The present teaching generally relates to sports equipment. More specifically, the present teaching relates to synchronization in rowing.

2. Technical Background

Rowing is a popular sport. There are different types of rowing, including sculling and sweep rowing. In sculling rowing, each rower rows with two oars, with each hand holding one oar on each side. In sweep rowing, each rower holds one oar with both hands. In the latter sweep rowing, there are even number of rowers with an equal number of rowers rowing on each side. This is illustrated in FIG. 1A, where a boat 100 in water 110 with 8 rowers (120-1, . . . , 120-8) therein and each rowers holds an oar 130 with a blade 140. The boat moves forward when the rowers push the oars in a direction that causes the blades push water 110 in an opposite direction. One of the crew members on each boat is called coxswain who is located on one end of the boat to steer the boat, provide instructions, or motivate the rest of the crew.

As the boat moves forward in one direction whenever the rowers push water in the opposite direction (or stroke), each rower goes through the cycles of 4 stages, including catch, drive, finish, and recovery. The stage of "catch" corresponds to the time of putting the oar blade into the water to begin the stroke. The stage of "drive" corresponds to the duration of a stroke in which a rower pushes the oar so that the blade pushes the water. The stage of "finish" corresponds to the time when a stroke is completed and the oar is lifted out of water (i.e., finish the drive). The stage of "recovery" corresponds to the period from lifting the oar out of water to the stage of "catch," i.e., putting the oar back into the water to start another cycle. FIG. 1B shows these four stages in relation to the displacement of a rower while going through these 4 stages in one cycle. As illustrated, rowboat 100 has two ends, one is bow and the other is stern. The boat is advancing in a direction towards the bow and the rowers are facing the stern.

During each cycle, each rower pulls the oar while the oar is in the water to push the water toward the stern direction so as to push the boat toward the direction of the bow. Each rower may be seated on a movable seat and the feet of each rower are positioned at a fixed location so that the rower may push the seat away or draw closer when needed. Given that, there is a displacement for each rower during one cycle as illustrated (e.g., rower 120-5). In general, at catch, rower 120-5 is at a position 150, which is a position where the rower is closest to the feet. At catch point, the blade of the oar is put back into the water and the rower start the drive stage by pulling the oar backward and extending the body backward, via, e.g., pushing the feet on the fixed location. While the blade is pushed through the water in the water phase as shown in FIG. 1B, the rower's position changes from catch position 150 to finish position 160 when the rower releases the oar to complete the stroke. To start the next cycle, the rower has to go through the recovery stage, in which the rower returns from the finish position 160 to the catch position 150, from which the next cycle starts with the next catch.

Inconsistency across different rowers exists, which is known to negatively impact the performance of rowing. Particularly the inconsistencies on the timings of "catch" and "finish" may cause counterproductive consequences. To maximize the speed of the boat, it is important to synchronize each stroke, i.e., the timing on "catch" and the timing on "finish." As each rower's physical characteristics and physiological ability may differ, such differences may influence how each rower accomplish various stages in each cycle. FIG. 1C illustrates an exemplary situation, in which two adjacent rowers (e.g., 120-2 and 120-3) may act differently during the recovery stage, i.e., the stage where a rower goes back to the catch position 150 from the finish position 160. As illustrated, rower 120-3 advances faster than rower 120-2, which can be seen that while the hands of rower 120-2 are just passing the knees, that of rower 120-3 have already passed the feet or close to the feet. This can also be evidenced that the angles (170 and 180) of the oar are different with a discrepancy A.

Effort has been made to improve the synchronization of rowers, particularly on the catch and finish stage. Coxswain may provide punctuated oral instructions. This does not work well as it does not effectively help rowers to regulate their actions in different stages to meet the required rhythm. Other efforts include using timing devices to deliver visual information to rowers or informing discrepancy between desired and actual timings using changes in seats' acceleration. These are not helping rowers to obtain feedback as to what they should improve. In addition, some techniques (such as analog signal-based solutions) used to detect acceleration or changes thereof are known to be unreliable. Thus, there is a need for a solution that address the shortcomings and enhance the performance of these traditional protectors.

BRIEF DESCRIPTION OF THE DRAWINGS

The methods, systems and/or programming described herein are further described in terms of exemplary embodiments. These exemplary embodiments are described in detail with reference to the drawings. These embodiments are non-limiting exemplary embodiments, in which like reference numerals represent similar structures throughout the several views of the drawings, and wherein.

DETAILED DESCRIPTION

Figure 1A:
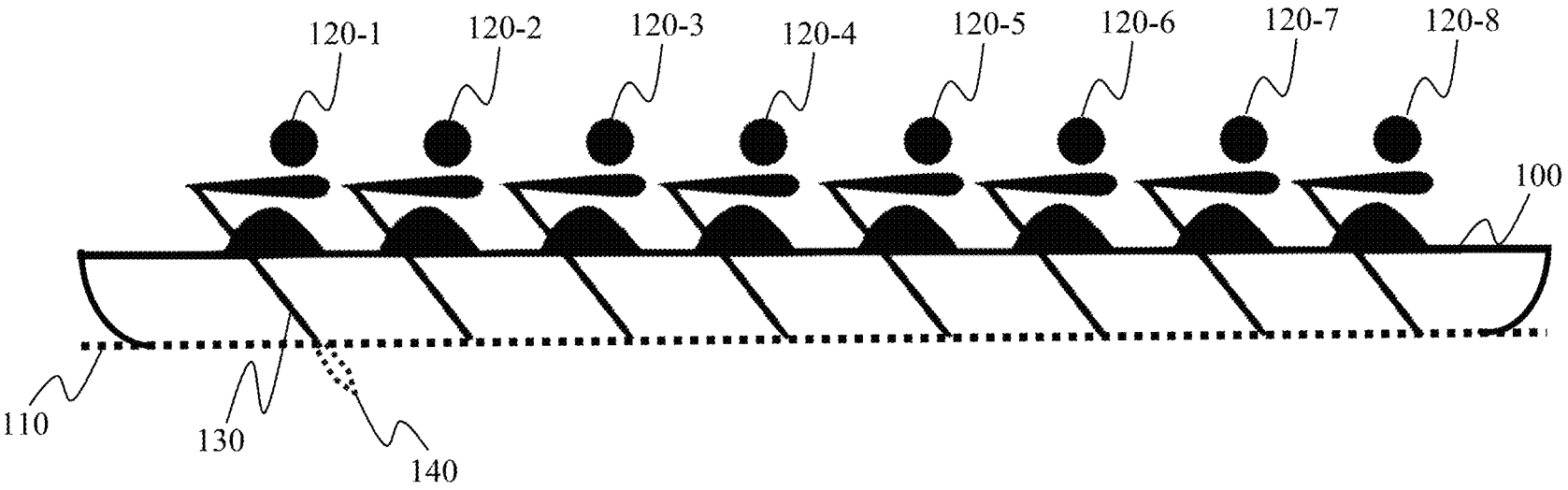
FIG. 1A shows a rowboat with rowers.

In the following detailed description, numerous specific details are set forth by way of examples in order to facilitate a thorough understanding of the relevant teachings. However, it should be apparent to those skilled in the art that the present teachings may be practiced without such details. In other instances, well known methods, procedures, components, and/or system have been described at a relatively high-level, without detail, in order to avoid unnecessarily obscuring aspects of the present teachings.

The present teaching is directed to method, system, and implementation of synchronizing relevant events in rowing for the purpose of optimizing performance of a rowboat. Different events associated with each stroke cycle are monitored based on an instructed timing signaling of different events, determined based on a dynamically determined speed for the rowboat based on the real-time situation. In some situations, a personalized timing signaling for different events may be generated based on the instructed timing signaling and the past performance records for an individual rower. In the framework of known stroke cycle with 4 phases ("catch," "drive," "finish," and "recovery"), the most important events that need to be synchronized are "catch" and "finish," respectively because asynchronous timing thereof directly impact the speed of the rowboat. Between these two, the "catch" phase is crucial as its timing largely determines the timing of the "finish" phase. Given that, the activities and synchronous thereof during the "recovery"

phase are important as they lead to consequential "catch" timing. Prior efforts of synchronize rowers' timings on "catch" and "finish" without paying attention to the "recovery" phase which builds up to the "catch" and consequently the "finish" timings.

The present teaching discloses a scheme for enhanced synchronization in rowing. Different events in different phases are monitored using appropriate sensors and monitored discrepancies on such events are instantaneously feedback to each rower to help to carry out targeted improvement in the next cycle. In addition to the known significant events such as "catch" and "finish," additional points of monitoring are identified to facilitate the effective build-up sync'd "recovery" phase to enhance the chance to sync at the "catch" point and subsequently at the "finish" phase. In some embodiments, such additional events in the "recovery" phase include the time that the rower's arms or the oar passing certain landmark points to help each rower to regulate the activities during the "recovery" process.

To monitor the timings of different events in each stroke cycle, sensors may be deployed to reliably detect the occurrence of corresponding events. In some embodiments, a laser-based distance sensor may be placed at appropriate location, either on a rower or on the rowboat, to monitor the event that an oar held by the rower passes respective landmark points, such as the rower's knee and the rower's ankle. The timing of "catch" may be monitored via an oarlock sensor, which provides various information related to the operation of the oar, including the timings of "catch" (the timing of the oar blade entering into the water) and "releasing" (the timing of the oar blade getting out of the water). The monitored timings of different events are used to compare with a timing signaling instruction for each stroke cycle, where the timing signaling instruction is generated based on a desired speed which dictates the length of each stroke cycle. The comparison between the collected monitored timings of different events with respect to individual rowers may yield personalized performance information with respect to each of the rowers and can be fed back to each of the rowers to assist each to adjust their actions to improve synchronization in the next cycle.

In competitive rowing, the coxswain on each rowboat determines, in real-time, a desired speed (e.g., strokes per minute) and then communicates that to the crew members so that all can adjust their actions to achieve the desired speed. Based on this desired speed, a timing signaling instruction may be generated for each stroke cycle. The timing signaling instruction may provide the timings for different events, determined based on, e.g., the past experience cumulated in the sport of rowing on the relative duration between adjacent events given the desired speed or a coach according to, e.g., past observations made on the crewmembers. Such timing signaling instruction may be designed to optimize the synchronization to maximize the speed of the boat. The timing of each timing signal as provided in the timing signaling instruction may be designated to a particular event (e.g., catch event, finish event, passing the knee event, and passing the ankle event) and is used to compare with the timing of the designated event as monitored by the sensors related to each of the rowers. The comparison of each designated event with respect to a rower may yield an instant report indicating whether the rower is in sync, ahead, or behind the instructed timing for the designated event and may be reported back to the rower on-the-fly.

Figure 1B:
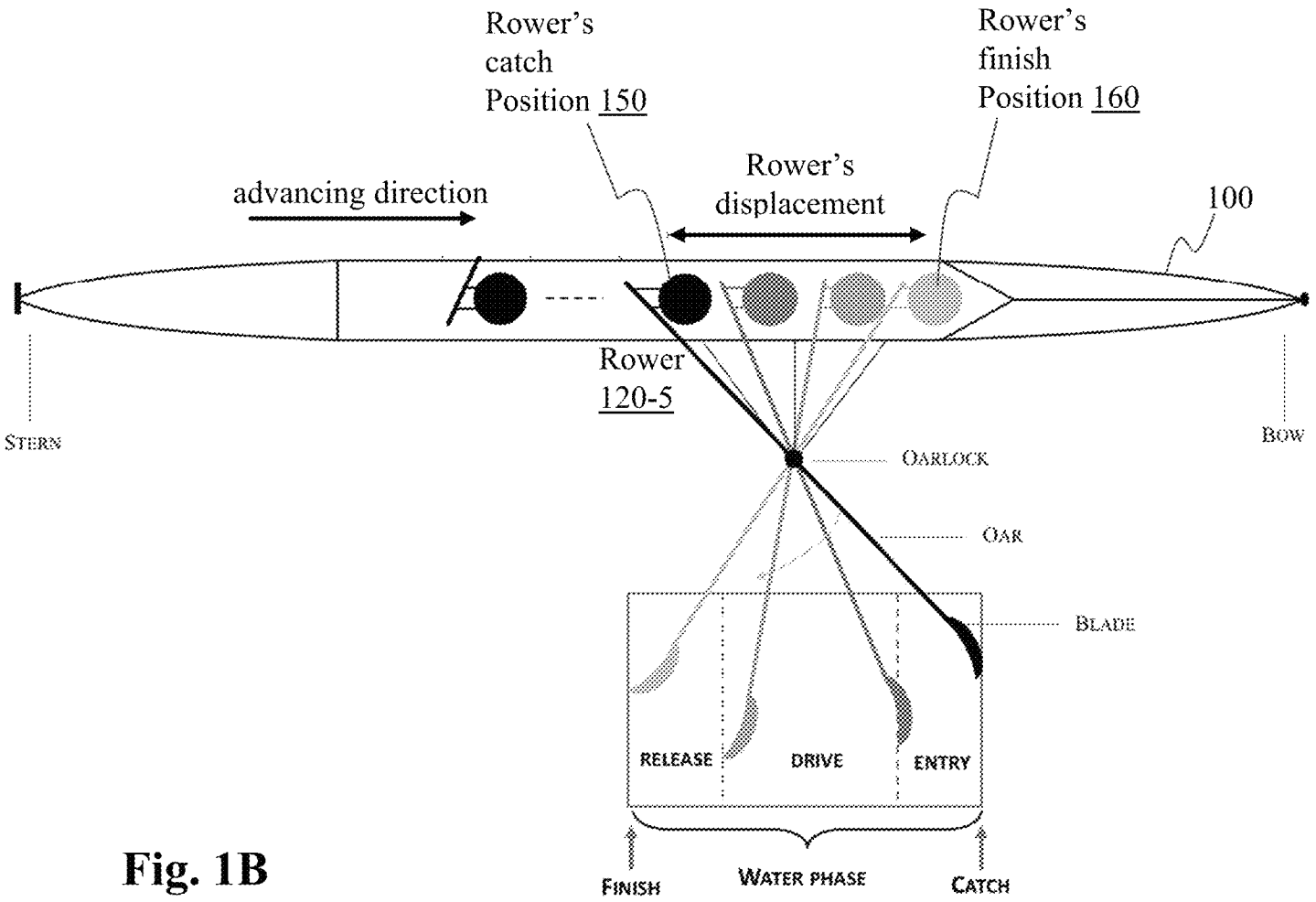
FIG. 1B details different stages of a stroke cycle and displacement of rower's positions in the rowboat.
Figure 1C:
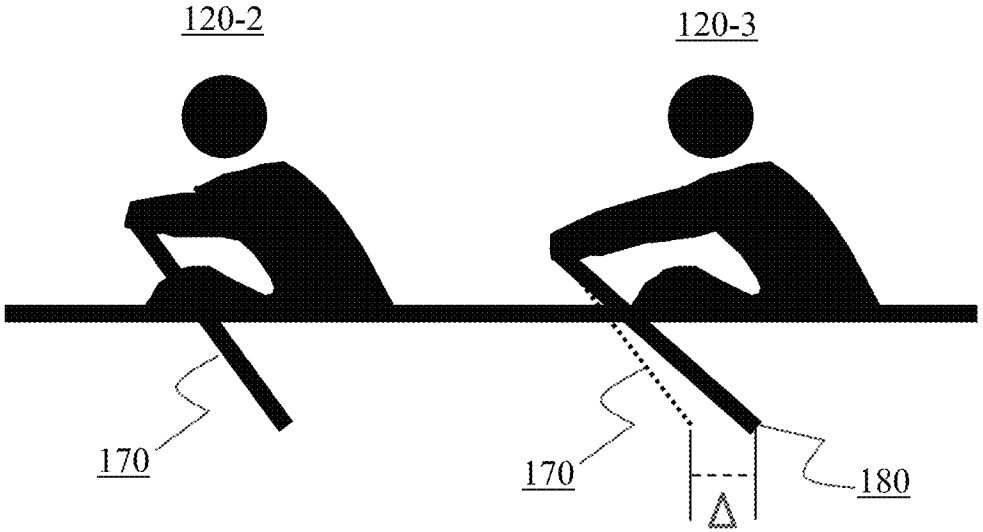
FIG. 1C illustrates an example of two rowers not in sync.

As discussed herein, in addition to the important event associated with "catch" and "finish," other events may be monitored during the "recovery" phase to improve the chance to sync on "catch." As shown in FIG. 1B, during the process of "catch," "drive," and "finish" phases, the rower stretches his/her body backwards so that one end of the oar held by the rower goes through the same displacement as the rower's body to reach the "finish" position. To start the next stroke cycle, the rower then undergoes the opposite displacement (forward towards the rower's feet) while holding the oar so as to bring the oar back to the "catch" position. This "recovery" phase is important as it directly impacts whether the "catch" is synchronized. In some embodiments, two additional events are defined during the "recovery" phase so that the attempt to synchronize on these two landmark points may positively improve the synchronization on "catch" event. The first additional event is defined when the oar passes the rower's knee. The second additional event is defined when the oar passes the rower's ankle.

Figure 2:
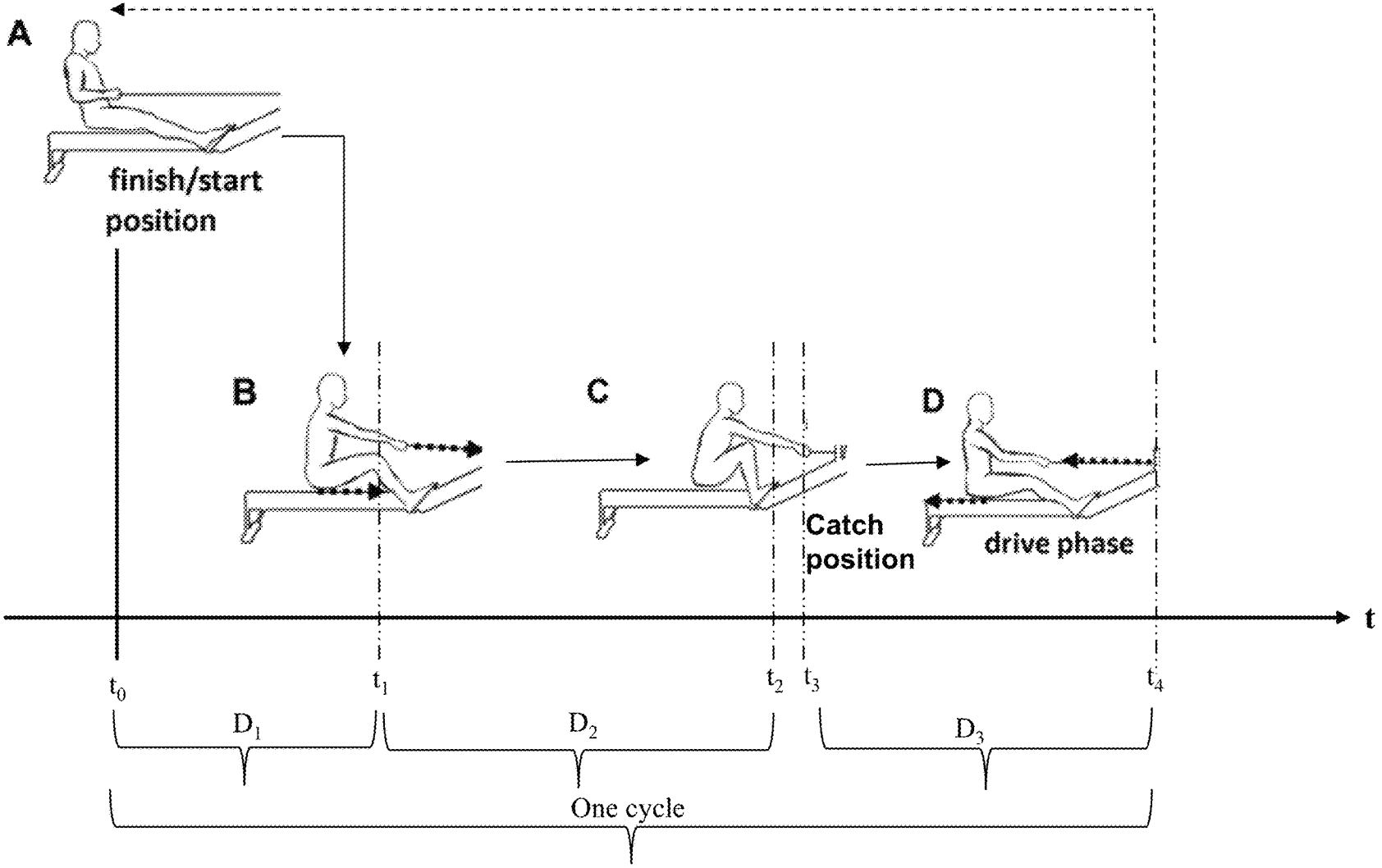
FIG. 2 depicts a stroke cycle with additional event points relevant to synchronizing rowers, in accordance with an embodiment of the present teaching.

This is illustrated in FIG. 2, which shows landmark events to be synchronized during each stroke cycle, in accordance with an embodiment of the present teaching. The time instant to represents the start position A of a cycle; $t_1$ represents the time for event B when the oar (or the arm that holds the oar) passes the rower's knee; $t_2$ represents the time of event C when the oar (or the arm) passes the rower's ankle; $t_3$ represents the "catch" moment when the oar enters into the water; and $t_4$ represents the "finish" point after a drive period D in the water, where $t_4$ corresponds to the start point to. It is noted that the timings of these events and relative lengths thereof as shown in FIG. 2 are merely for illustration and they are intended to show the proportions of these events as to the lengths of corresponding durations. At those designated events, the starting timing of each is monitored using appropriate sensor(s) and the detected timings of such events are then compared with the required timings as specified in a timing signaling instruction, as discussed herein.

With regard to sensors that may be deployed to monitor the timings of different designated events, different alternatives are discussed herein such as an optical distance sensor, a visual sensor, or a motion sensor. Other sensors may also be used without any limitation. Depending on what is to be monitored, a sensor may be deployed at an appropriate location in different means to ensure capturing of the designated event. In some situation, a sensor for monitoring the knee passing event may be placed on the leg of the rower or affixed on to the wall of the boat on the side of the oar. The sensor to monitoring the passing the ankle event may be affixed on top of the holder of the rower's feat. A sensor for monitoring the timing of the "catch" may correspond to an oarlock which measures the timings of oar's entering and leaving based on pressure on the oarlock. These sensors may be wirelessly connected with a central unit operating on each rowboat to provide the monitored timings of different events associated with different rowers on the boat to the central unit to record the performances.

With respect to each event in each stroke cycle, a rower may be synchronized, or ahead or behind of an instructed timing on the same event. For each of the three statuses with respect to the event, each status may be feedback to the rower in a different style, e.g., sync using a normal tone, ahead using a moted pitch tone, and behind using a high pitch tone. Each rower may develop own preferred feedback style and such personalized configuration may be utilized. In some embodiments, such feedback may also be provided to a rower via other means such as via vibration and different frequencies may be used for each of the feedback statuses. In some embodiments, a rower may also configure, in a personalized manner, what to be monitored (i.e., what is not to be monitored) based on, e.g., his/her own past performances. For instance, if a rower consistently synchronizes very well on the event of oar passing the knee but still constantly behind on "catch," the rower may desire to monitor the timing of the event of oar passing the ankle to learn how to improve. In some situations, the central unit on each rowboat may require the timing of the "catch" event be monitored and fed back to the rowers.

When receiving the feedback on synchronization status on each of the designated events to be monitored, a rower may accordingly adjust own action in the next cycle to maximize the chance to synchronize with the timing signaling instruction provided based on the desired speed dynamically determined by the coxswain. Both the dynamically determined timing signaling instructions (as ground truth) as well as individually monitored synchronization performance for each rower at different times may be all stored in a central unit, which may be implemented on a smart phone, on a tablet, or any other specially made device, as performance data. Each rower may access his/her own performance data, or a personalized practice guide created based on the performance data specifically for the rower. For instance, if a rower exhibits some consistent performance, e.g., behind the timing signaling instructions, beyond certain speed, then the personalized practice guide may suggest the rower to practice at a high-speed setting to train the muscle to adapt to the higher speed scenarios.

Figure 3B:
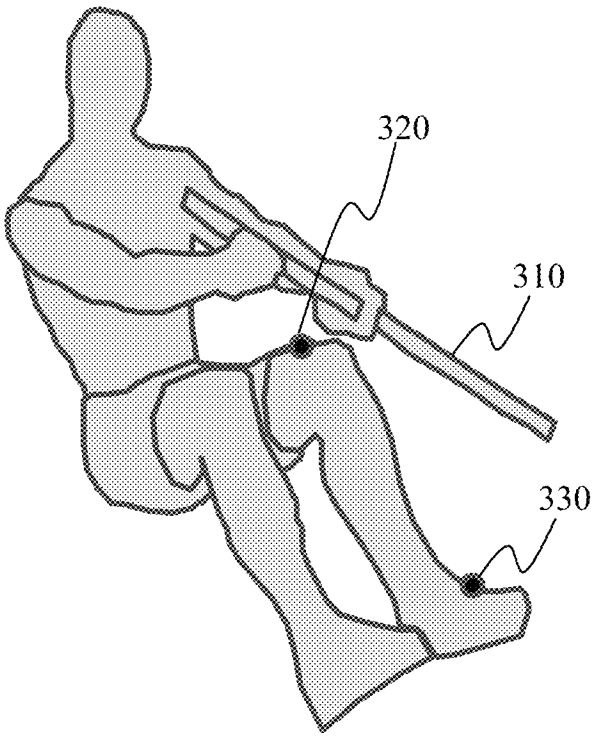
FIG. 3B depicts placements of sensors at an exemplary position to detect action relevant to synchronization in sweep rowing, in accordance with an exemplary embodiment of the present teaching.
Figure 3A:
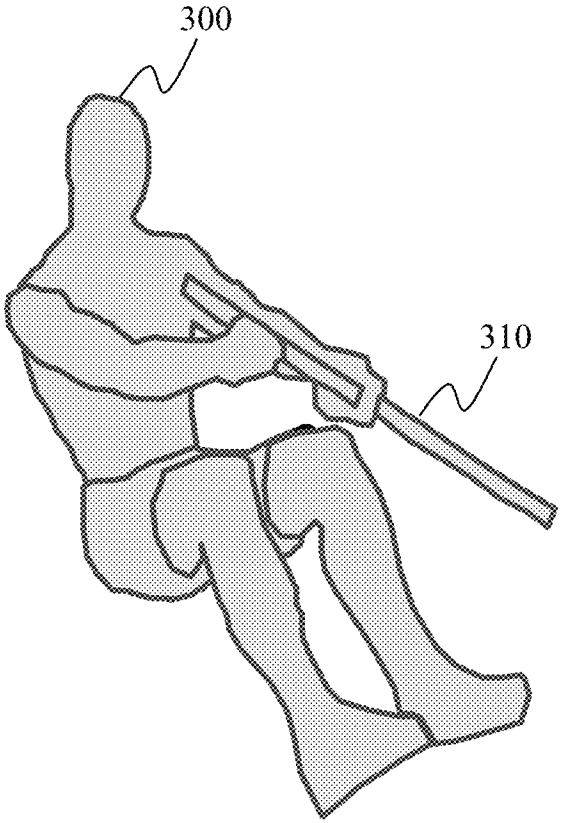
FIG. 3A illustrates a rower in sweep rowing.

FIG. 3A illustrates a rower in sweep rowing, i.e., the rower 300 uses both hands to hold on an oar 310 to row on one side of a rowboat. To detect the first and second landmark events of, i.e., passing the knee and the ankle, in a sweep rowing setting, sensors for measuring the timings of such corresponding events may be placed at appropriate locations. FIG. 3B depicts exemplary placements of sensors at exemplary positions to detect actions relevant to synchronization in sweep rowing, in accordance with an exemplary embodiment of the present teaching. In this illustration, a sensor 320 for detecting the timing ($t_1$) of the event of passing the knee may be placed on one knee, facing up, of the rower on the side of the oar. In some embodiments, the sensor 320 may be tied to the leg of the rower using, e.g., a band or affixing one side of the sensor 320 on the leg via some sticky material. Another sensor 330 for detecting the timing ($t_2$) of the event of passing the ankle may be placed on one foot, also facing up, of the rower on the side of the oar. A rowboat usually has holder of feet for rowers and such a holder is a fixture on the rowboat. In this case, the sensor 330 may affixed to the left foot holder by any means available.

Figure 3D:
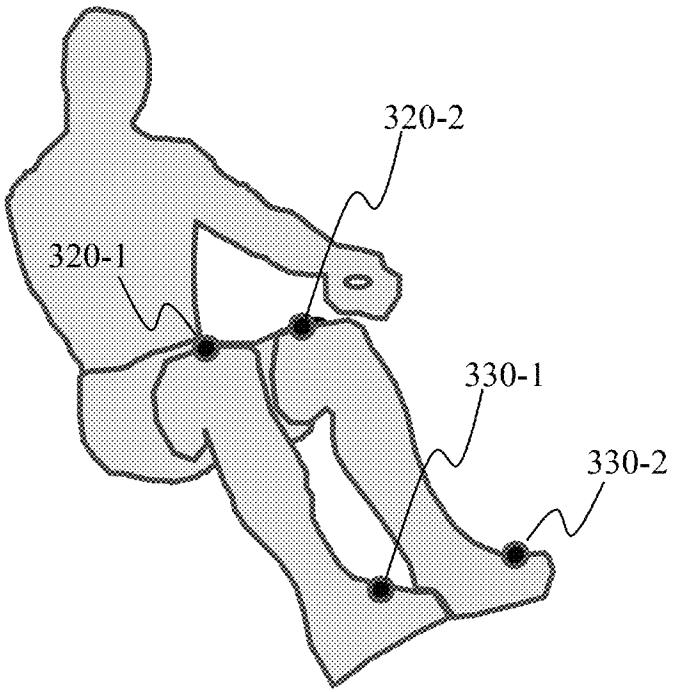
FIG. 3D depicts placements of sensors at exemplary positions to detect action relevant to synchronization in sculling rowing, in accordance with an exemplary embodiment of the present teaching.
Figure 3C:
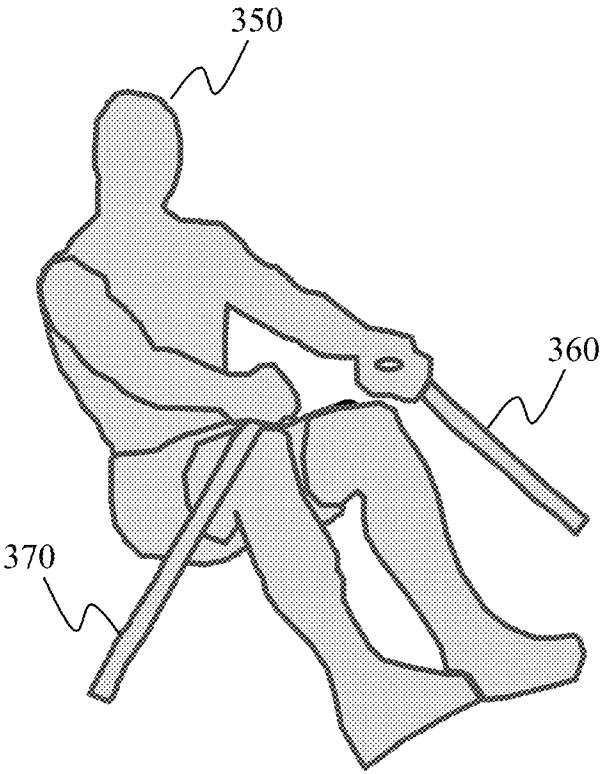
FIG. 3C illustrates a rower in sculling rowing.

FIG. 3C illustrates a rower 350 in sculling rowing, wherein the rower 350 rows two oars, 360 and 370 and one on each side. To detect the first and second landmark events of passing the knee and passing the ankle, in a sculling rowing setting, sensors for measuring the timings of such corresponding events may be placed at appropriate locations. FIG. 3D depicts placements of sensors at exemplary positions to detect actions relevant to synchronization in sculling rowing, in accordance with an exemplary embodiment of the present teaching. Similar to what is shown in FIG. 3B, sensor 320 is for detecting the timing ($t_1$) of the event of passing the knee and sensor 330 is for detecting the timing ($t_2$) of the event of passing the ankle. As a rower in sculling rowing handles two oars, the timing of passing the knee may be detected on one or both sides. Similarly, the timing of passing the ankle may be detected on one or both sides. FIG. 3D illustrates an exemplary setting in which such events are monitored on both sides, measuring the synchronization of each side separately. For example, sensor 320-1 and 320-2 may be respectively deployed on the left and right legs of the rower 350, where sensor 320-2 is for monitoring the timing of the oar 360 on the left side passing the left knee while sensor 320-1 is for monitoring the timing of the oar 370 on the right side passing the right knee. Similarly, sensors 330-1 and 330-2 are deployed respectively on the right and left feet, monitoring the timing for oar 370 on the right passing the right ankle and that for oar 360 on the left passing the left ankle.

Figure 3F:
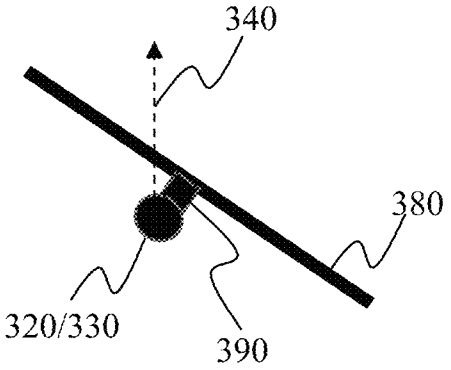
FIGS. 3E-3F illustrates alternative placement positions of sensors to detect actions relevant to synchronization in rowing, in accordance with an exemplary embodiment of the present teaching.
Figure 3E:
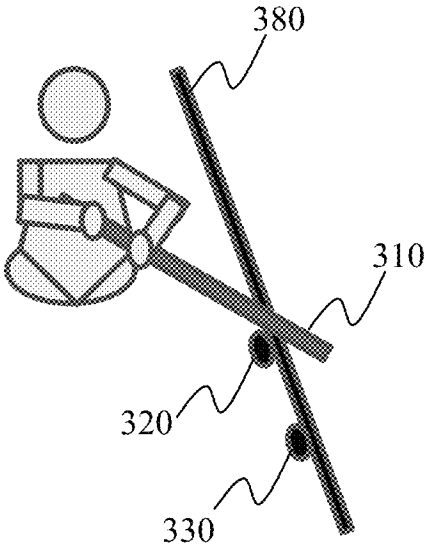

In some embodiments, the sensors for monitoring the timings of events of passing a rower's knee and ankle may also be deployed at other locations so long as each of the sensors has an unobstructed means to detecting the event to be monitored. FIGS. 3E-3F illustrate other alternative locations on a rowboat to affix the sensors, in accordance with an embodiment of the present teaching. In FIG. 3E, a substantially vertical wall 380 of the rowboat on left side of a rower may be utilized to affix sensors 320 and 330 at locations that are substantially parallel to the rower's knee and ankle, respectively. Such locations may be determined by having a simulated stroke cycle during which the positions of oar 310 may be marked when it passes the knee and ankle, respectively, during the motion. FIG. 3F illustrates an exemplary means to affix a sensor on the vertical wall 380, where a holder 390 for the sensor 320 or 330 may be affixed against the wall 380 (or on its rim thereof) and the sensor is then affixed on the holder 390. The holder 390 and the sensor thereon (320 or 330) may be deployed in such a way that the sensor has any unobstructed sensing direction 340, which is obstructed only when the oar 310 passes the location (other times, what is sensed is something very far such as the sky).

Figure 3G:
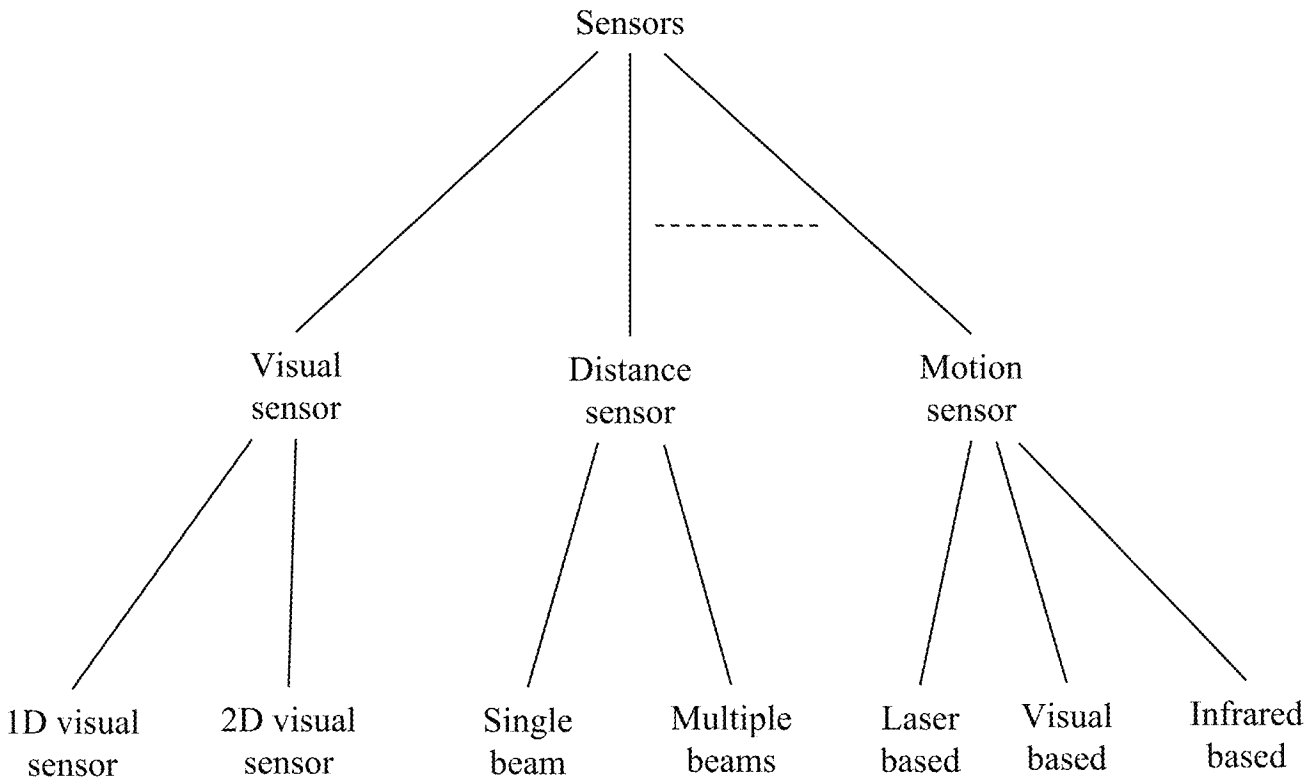
FIG. 3G illustrates exemplary types of sensors that can be used to detect relevant events for synchronization, in accordance with an embodiment of the present teaching.

FIG. 3G illustrates exemplary types of sensors that may be used to detect timings of relevant events for synchronization, in accordance with an embodiment of the present teaching. As shown, such sensors may include a visual sensor, a distance sensor, . . . , or a motion sensor. A visual sensor may be a 1D visual sensor or a 2D visual sensor. A distance sensor may include laser-based single beam distance sensor or laser based multi beam distance sensor. A motion sensor may include a laser-based motion sensor, a visual based motion sensor, or an infrared based motion sensor. Those mentioned in FIG. 3G are merely for illustration purpose and are not intended as limitations. Any other type of sensors, either existing or developed in the future, may be deployed to determine the timing of relevant event as appropriate. The details of detecting timings $t_1$ and $t_2$ are provided below and the disclosure is provided with respect to the sweep rowing. The same detection scheme may be applied to the sculling rowing on different sides of the rowboat.

Figure 4B:
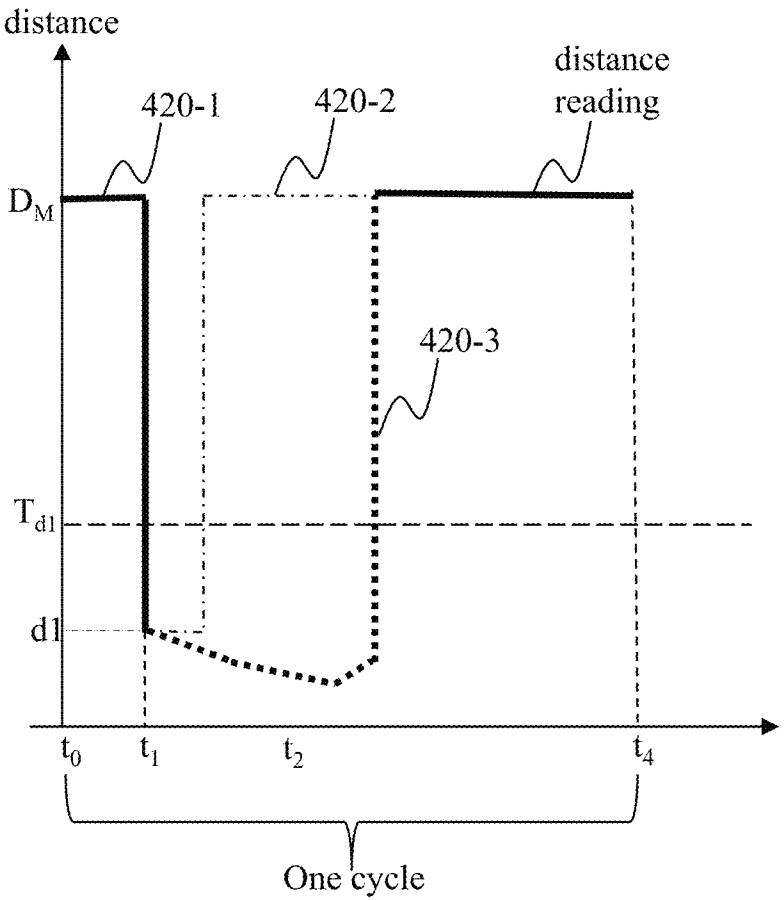
FIGS. 4A-4B depict an exemplary scheme of detecting a relevant event via a laser distance sensor and an expected profile signifying the relevant event during a stroke cycle, in accordance with an embodiment of the present teaching.
Figure 4A:
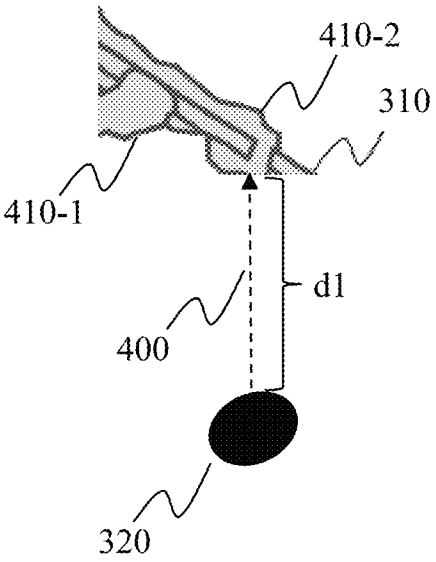

FIGS. 4A-4B depict an exemplary scheme of detecting the event of an oar passing a rower's knee via an exemplary laser distance sensor and an expected profile of distance reading, in accordance with an embodiment of the present teaching. FIG. 3A shows a scenario where a rower using two hands to hold an oar in sweep rowing and detection of the timing $t_1$ of the event that the oar (or one hand holding it) is based on distance readings from a laser distance sensor 320. As discussed herein, sensor 320 may be installed at an appropriate location (either on the rower or somewhere affixed on to the boat) and may emit a laser beam 400 upward in a direction which is estimated to be intersected by the oar during each stroke cycle. With a last distance sensor, when laser hits an object, the sensor 320 may generate a distance reading indicative of the distance between the sensor and the object. In some implementations, the laser-based distance sensor 320 may be configured to have a maximum distance range. That is, a distance reading may be obtained from the sensor when an object appears within this maximum distance range. When there is no object present within this range, the distance sensor may produce either a default maximum distance reading DM or no reading at all.

FIG. 4B illustrates an exemplary distance reading profile from the exemplary distance sensor 320 with a default distance reading being a maximum distance reading DM. In this illustration, one cycle is shown with instructed starting time to and ending time $t_4$. During the cycle, the sensor 320 may emit a laser beam 400 as shown in FIG. 4A. The distance readings may be obtained at a sufficiently high frequency for the application in hand. For instance, it may be to sample the distance reading 10 times per second. The detection may be activated at to and once the timing of the designated event is determined, the detection may stop until the start of next cycle (next to). As discussed herein, to corresponds to a time after a rower pulls backward with the oar closest to the chest or furthest from the "catch" position. At this point of time, as the oar is not near the location of sensor 320, the upward laser beam (directed to the sky) emitted by sensor 320 encounters no object so that the sensor 320 produces the default distance reading, i.e., DM, as shown in FIG. 4B in this example. From this point on, the rower moves forward, trying to bring the oar back to the "catch" position. During this process, at some point, e.g., at $t_1$, the oar passes where the sensor 320 is deployed and intersects with the laser beam 400 as shown in FIG. 3A. As such, the distance reading from the sensor 320 accordingly starts to obtain non-default distance reading, e.g., a distance reading d1, and such a non-default distance reading represents the distance from the oar to the sensor 320 within its sensing range.

The sensor 320 may be configured to operate based on a distance threshold $T_{d1}$ so that when the distance reading from the sensor first drops from DM to below $T_{d1}$, that moment represents the timing that the oar starts to pass the rower's knee. This is illustrated in FIG. 4B, where the distance reading 420-1 starts with the default reading DM and at time $t_1$, it drops to d1, which is lower than threshold $T_{d1}$ so that $t_1$ indicates that the oar is presently in close range with the sensor. In some embodiments, the threshold $T_{d1}$ may be set according to specific considerations in different applications, including, e.g., the location of the sensor, the location of the oar, and possibly height of the potential rowers. It is possible that there are multiple distance readings below the threshold $T_{d1}$. This is shown in FIG. 4B where 420-2 and 420-3 may represent the distance reading profiles under different circumstances after the first sharp drop at $t_1$. In some embodiments, the sensor 320 may be configured to use $t_1$ as the timing that the oar starts to pass the sensor and ignore subsequent varying distance readings until the next cycle begins again.

Figure 4D:
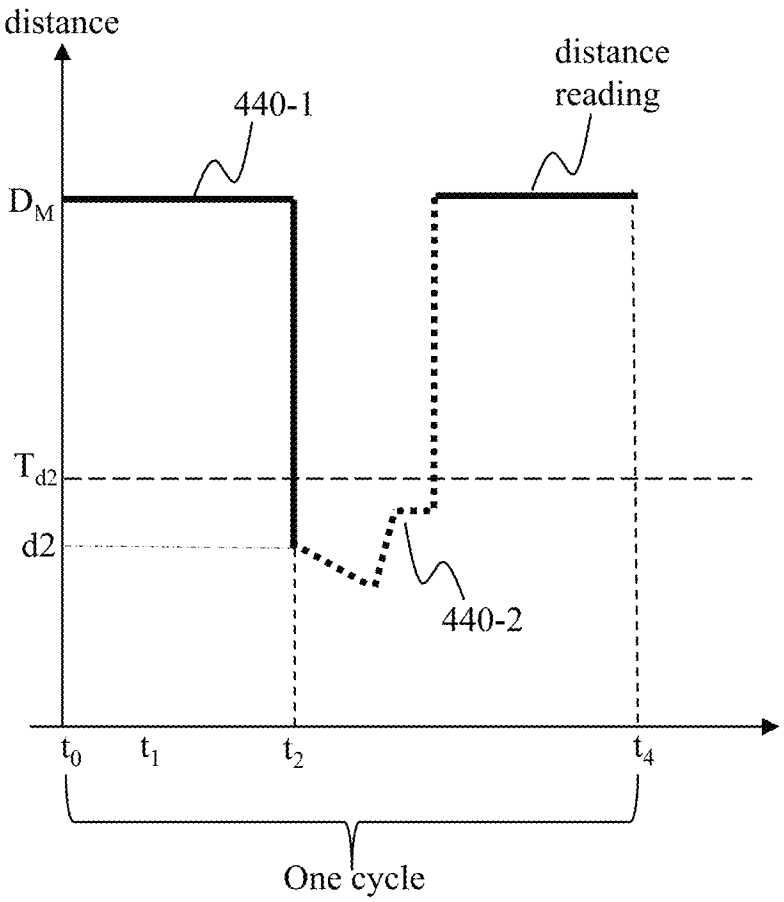
FIGS. 4C-4D depict an exemplary scheme of detecting another relevant event via a laser distance sensor and an expected profile signifying the other relevant event during a stroke cycle, in accordance with an embodiment of the present teaching.
Figure 4C:
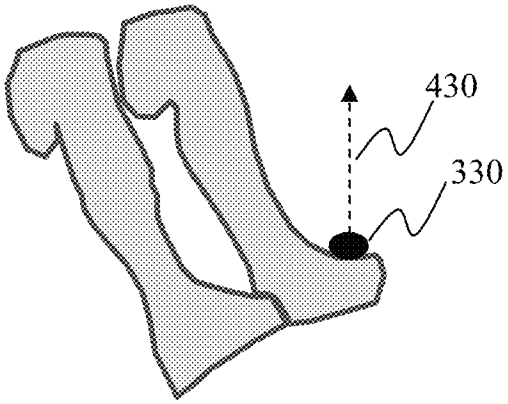

FIGS. 4C-4D depict an exemplary scheme of detecting the timing of the event of an oar passing the ankle via a laser distance sensor and an expected profile in distance readings, in accordance with an embodiment of the present teaching. As discussed herein, another landmark event during the "recovery" phase is when an oar passes the rower's ankle at time $t_2$. To detect the timing of this event, a sensor may be deployed on an appropriate location, e.g., next to the heel portion of a foot holder affixed to the rowboat or in some situations on top of the foot holder that approximates the ankle location. FIG. 4C illustrates a sensor 330 placed on top of a foot holder on the side of the oar and in this illustration, the sensor corresponds to a laser distance sensor that emits a laser beam upwards so that when the oar passes the rower's ankle, the oar will be intercepted by the emitted laser beam to yield a distance reading (as discussed herein, prior to that, the distance reading may be default reading DM). The scheme of detecting the timing of this event is the same as what is disclosed with reference to FIGS. 4A-4B, except that that the distance reading profile 440 associated with the sensor 330 is different as shown in FIG. 4D. Similarly, the timing $t_2$ when an oar starts to pass the rower's ankle may be determined based on a detected sharp drop of the distance reading from DM to d2, where d2 is below a preset threshold $T_{d2}$. Also, as discussed with reference to FIGS. 4A-4B, once the timing for the event is detected, the distance reading after that point may be ignored until the next stroke cycle starts. With the detected timings of these two events, they may be compared with the corresponding timings regulated in the timing instruction to detect the discrepancy, if any, and inform such discrepancy to the rower to assist the rower. As these two events are pre-catch phase, better synchronization on these two events may lead to better synchronization on "catch" and "finish" which are crucial in maximizing the speed of the rowboat.

Figure 4E:
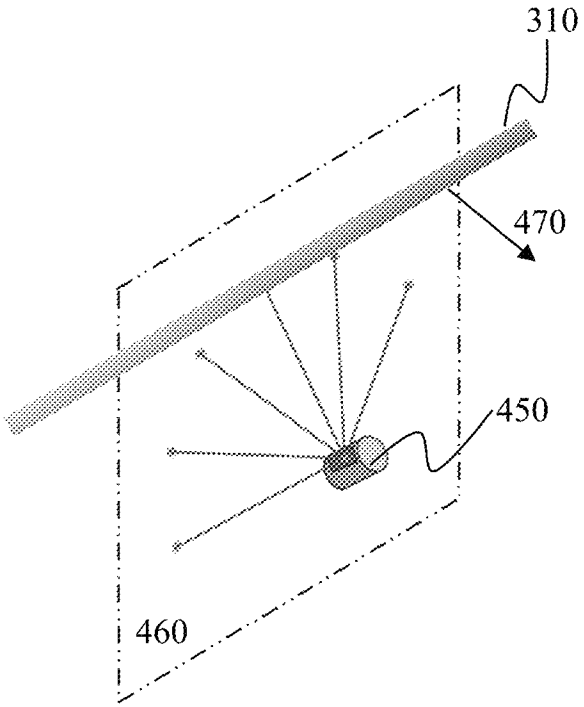
FIG. 4E shows a distance sensor that emits multiple laser beams on a plane.

FIGS. 4A-4D illustrate the use of laser-based distance sensors 320 and 330 for detecting the timings of two landmark events. In these examples, each sensor emits a single laser beam upwards directed at the pathway of the moving oar. In some implementations, a laser-based distance sensor may also emit multiple laser beams. FIG. 4E shows a distance sensor 450 that emits multiple laser beams that form a plane 460, that may be substantially parallel to the oar 310 so that when the oar 310 is moving in direction 470, any of the laser beams emitted by sensor 450 may intercept the oar at a passing point. With multiple laser beams along the oar as shown in FIG. 4E, it enhances the reliability of detecting the timings of the corresponding events. In some implementations, the distance reading from sensor 450 may be determined based on an instant where the first of the multiple laser beams intercept the oar. There may be other modes of operation in terms of how to yield the distance reading.

Figure 4F:
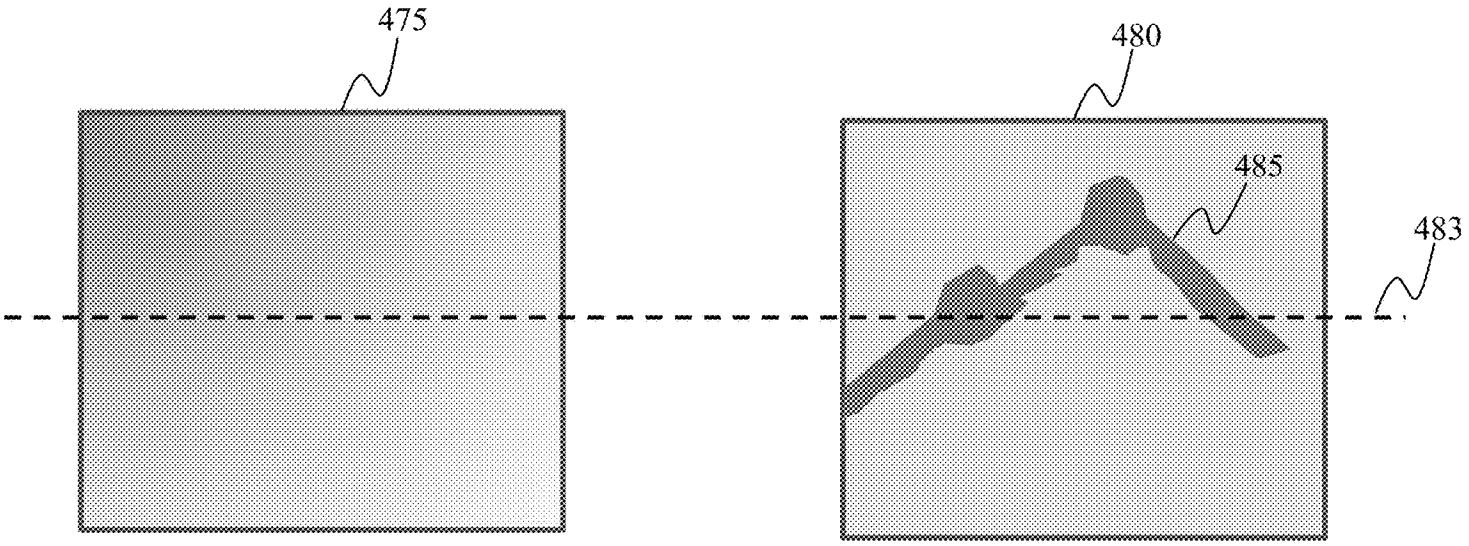
FIGS. 4F-4G show an exemplary scheme of detecting a relevant event via a two-dimensional (2D) visual sensor and an exemplary 2D image1 profile representing the occurrence of the relevant event, in accordance with an embodiment of the present teaching.
Figure 4F:
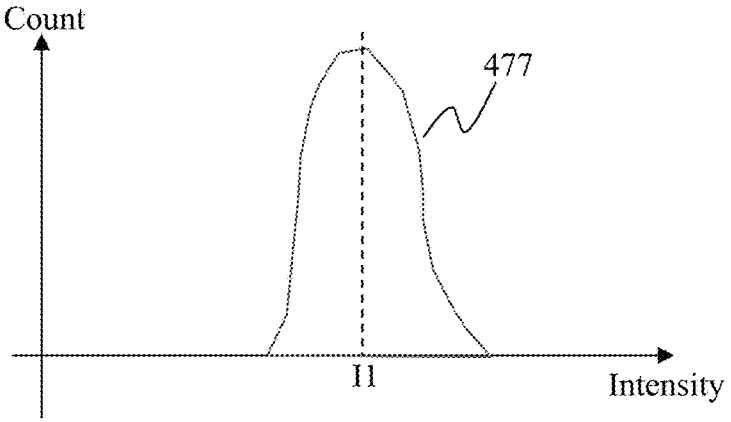
Figure 4G:
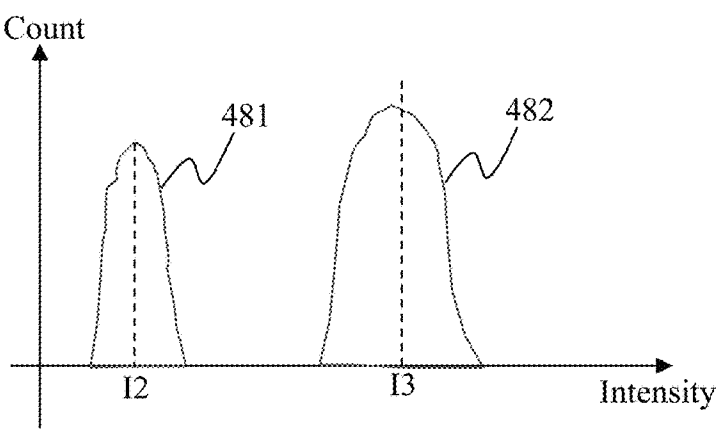

As shown in FIG. 3G, in addition to laser-based distance sensors, other types of sensors, such as visual or motion sensors, may also be used to detecting the timings of the landmark events during the "recovery" phase. FIGS. 4F-4G show an exemplary scheme of detecting the timing of an oar passing a rower's knee via a 2D visual sensor and an exemplary 2D image profile indicative of presence of the event, in accordance with an embodiment of the present teaching. A 2D visual sensor may be installed in a similar way as a distance sensor, i.e., at a location from where the passing of an oar may be observed, and the field of view of the camera in the visual sensor is directed upward to the sky. FIG. 4G shows an exemplary 2D image 475 acquired by a 2D visual sensor. As seen, the intensity across the image is relatively uniform (representing a patch of sky) even when there are clouds as it is generally known. During the "recovery" phase, when an oar is pushed forward and enters the field of view of the visual sensor in a much closer proximity, the 2D image 480 captured by the visual sensor at that moment includes the silhouette of the oar (with possibly hands depending on the location of the visual sensor) and the region 485 corresponding to the oar have pixels of much lower intensities, as illustrated in FIG. 4G. The presence of such changes represents the underlying event and can be detected from the 2D image.

There are fast ways to detect the presence of much darker regions in a 2D image with substantially uniform background as shown in FIG. 4G, where the background uniform background in the image corresponds to the upward scene such as sky and the much darker region 485 corresponds the image of the oar (possibly with hands). In some embodiments, a histogram approach may be used to obtain an intensity profile of a 2D image. In FIG. 4F, for the substantially uniform image 475, a histogram 477 may be obtained as shown, where the X axis corresponds to intensity values, the Y axis represents the count of pixels with respect to each intensity value, and histogram 477 represents a distribution of the pixel intensities of 2D image 475. As can be seen, for image 475, which has substantially uniform intensity distribution (because what is present in the field of view is substantially the sky) with a mean intensity value of I1 and some deviation. When an oar is passing the visual sensor, the captured 2D image 480 has a good portion of the pixels with much lower intensity values so that its histogram may exhibit the property as shown in FIG. 4G, where there are two distributions, 481 and 482, where the former 481 represents the distribution of pixel intensities of the region corresponding to the oar with an average intensity value 12, while the latter 482 represents the distribution of pixel intensities of the background (the skey) with an average intensity value 13, which may be substantially similar to I1. Generating histogram of a 2D image may be efficiently carried out. Detecting the histogram pattern may be carried out based on whether there is only one or more distributions. At a time of point, when the histogram with a distribution pattern as shown in FIG. 4G is detected, that is the timing of an oar passing the visual field of the sensor.

Figure 4I:
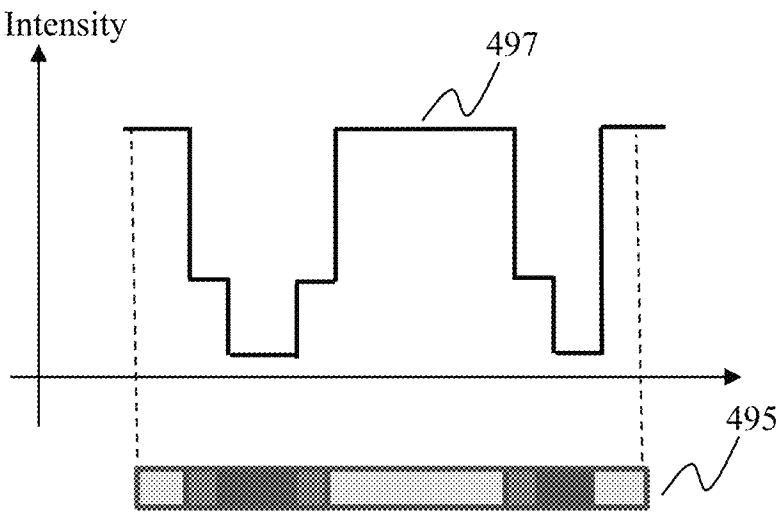
FIGS. 4H-4I show an exemplary scheme of detecting a relevant event via a one-dimensional (1D) visual sensor and an exemplary 1D signal profile representing the occurrence of the relevant event, in accordance with an embodiment of the present teaching.
Figure 4H:
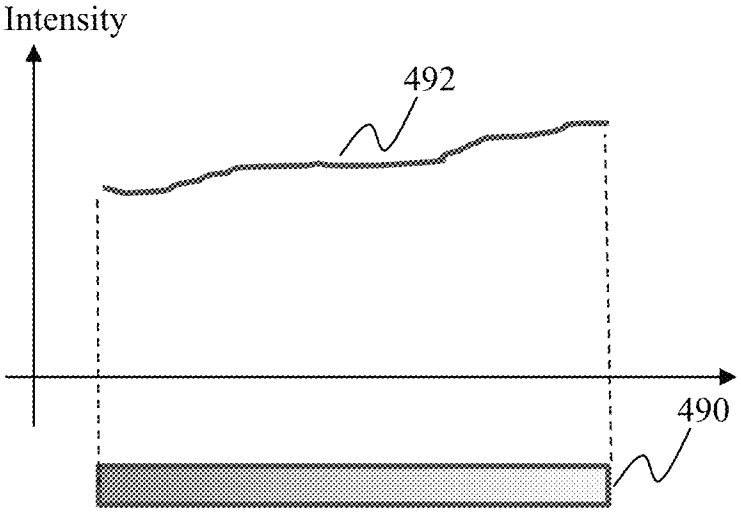

While detecting the timing of an event based on 2D image captured may be performed efficiently based on histogram approach, a more efficient visual based approach may also be employed. FIGS. 4H-4I show an exemplary scheme of detecting a passing event via a 1D visual sensor and exemplary 1D signal profiles for detecting the occurrence of the event, in accordance with an embodiment of the present teaching. FIG. 4H illustrates a 1D intensity vector 490 acquired by a 1D visual sensor without an event (to be detected) present and its corresponding intensity profile 492. Compared with the 2D image 475 in FIG. 4F, the 1D intensity vector 490 may correspond to one row in 475 along, e.g., the dotted line 483 across in FIG. 4F-4G. The intensities of the 1D intensity vector may be plotted in a sequential manner to generate the intensity profile 492 as illustrated in FIG. 4H. When there is no oar passing, as what the upwardly installed 1D visual sensor captures is likely the sky with relatively uniform intensities, the intensity profile 492 in this scenario is substantially flat or with intensity values that do not deviate from each other that much. FIG. 4I illustrates the situation when an oar passes the 1D visual sensor. For example, as the oar is passing the dotted line 483 as shown in FIG. 4G, the 1D intensity vector 495 is captured with the intensity distribution as shown in FIG. 4I. When 1D intensity vector 495 is plotted, it yields an intensity profile 497, which significantly differ from 492 and can be detected when it occurs as the timing of the underlying event.

Like the situation with distance sensors, a visual sensor may be deployed for monitoring the timing of a respective landmark event, including the event of an oar passing a rower's knee or the event of passing the rower's ankle. What is detected is the captured visual information at different times, each of which is associated with a time stamp. Based on such captured information, an expected signal profile indicative of the event may be detected. The time stamp associated with the visual information with an expected signal profile may be deemed as the timing of the event. To achieve that, a visual sensor may be placed securely at a location appropriate for the event to be detected so that when an oar passes the corresponding landmark point the visual sensor is able to capture the visual information needed. For example, a visual sensor for monitoring an event may be deployed at the similar locations as discussed herein for a distance sensor for monitoring the same event and affixed in a way that it has an upward field of view to capture a passing oar.

Figure 5A:
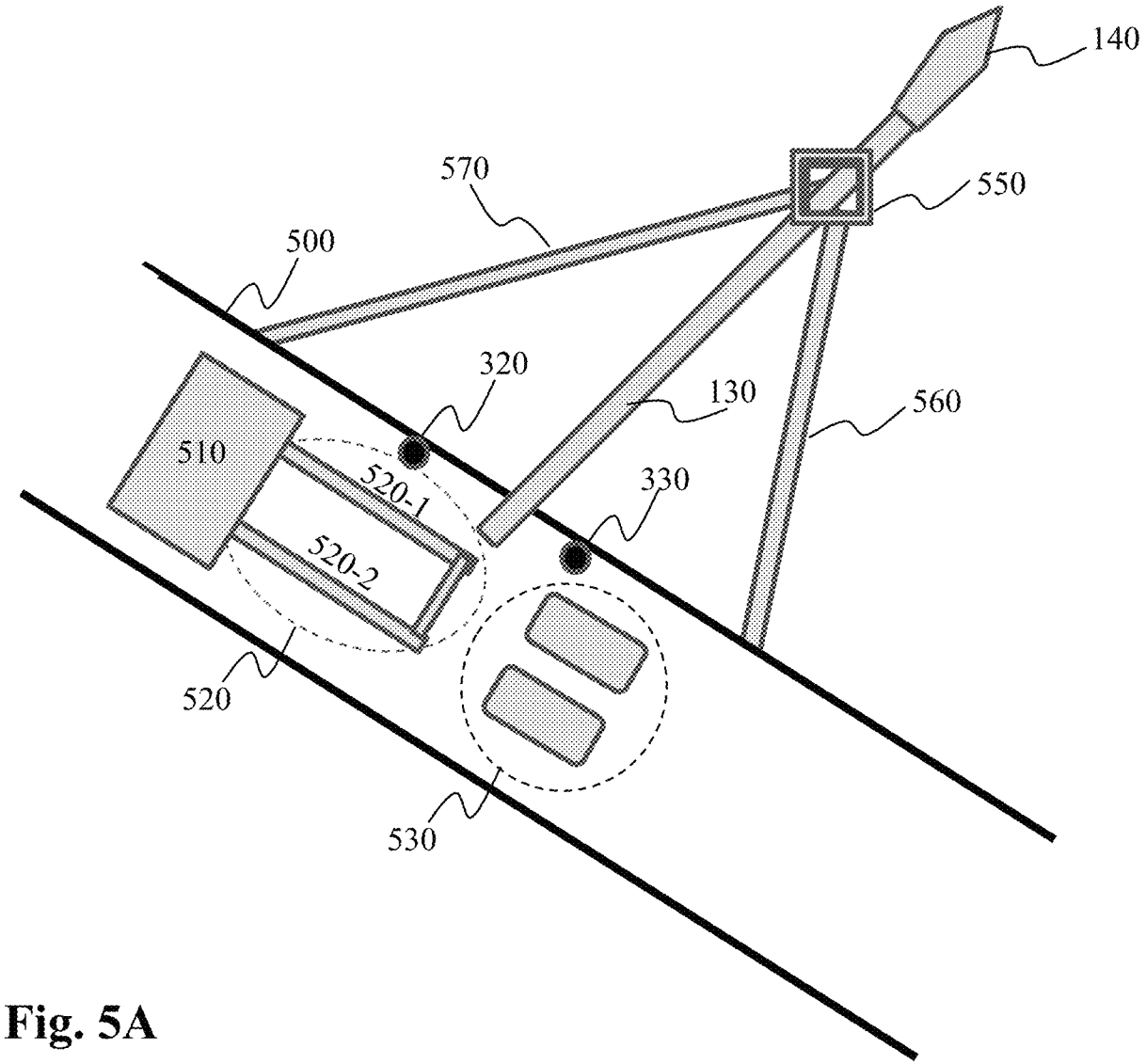
FIG. 5A shows an exemplary rower's station, in accordance with an embodiment of the present teaching.

With the timings for $t_1$ and $t_2$ are detected via sensors as discussed herein, other landmark events to be monitored in terms of timing for synchronization purposes include the timings on "catch" and "finish." In some embodiments, the timings of "catch" and "finish" may be detected using, e.g., an oarlock sensor, to be detailed with respect to FIGS. 5A-5D. FIG. 5A shows a rowboat with an exemplary rower's station 500, in accordance with an embodiment of the present teaching. In this illustration, the rower station 500 includes an exemplary rower's seat 510, a seat deck 520 with a track set 520-1 and 520-2, a footboard 530 with foot holders, a rigger with a left member 560 and a right member 570, an oar 130 with blade 140, and an oarlock 550. Also illustrated in FIG. 5A includes sensor 320 affixed along the vertical wall of the boat at an appropriate location to detect the timing when the oar 130 passes the rower's knee as well as sensor 330 affixed on the boat at a location to detect the time when oar 130 passes the rower's ankle. During a stroke cycle, a rower, sitting on the seat 510 and holding the oar 140, moves by sliding the seat along track 520, towards the footboard 530 (during which, sensors 320 and 330 detects the timing of passing the knee and ankle) until the catching point at which the rower lifts the oar so that the oar blade enters the water. From that point on, the rower's feet push against the footboard and extends the body backward so that the oar blade goes through the drive phase (see FIG. 1B) until the release of the blade to reach the finish point to lift the blade out of the water. At this point, the rower is back to the original position and one cycle is completed.

Figure 5B:
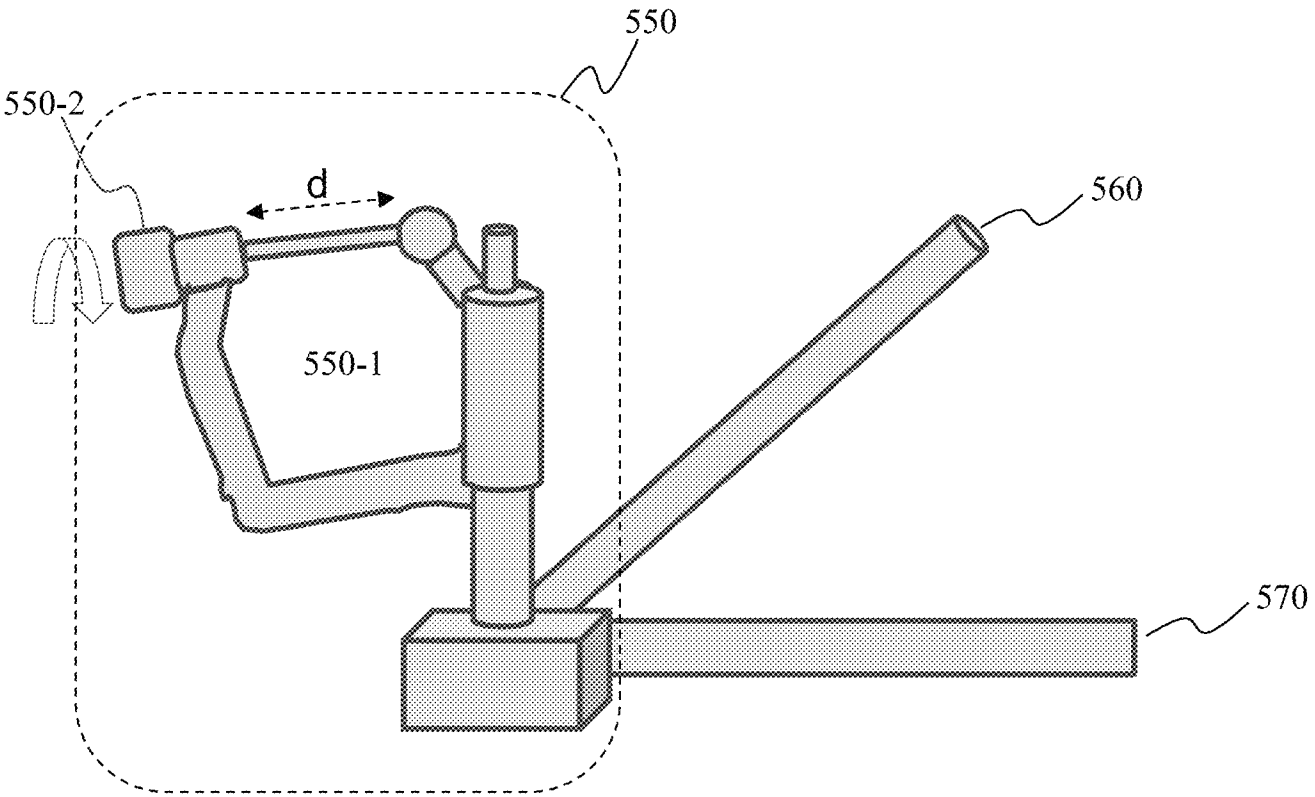
FIG. 5B shows an exemplary oarlock connecting to the rigger.
Figure 5C:
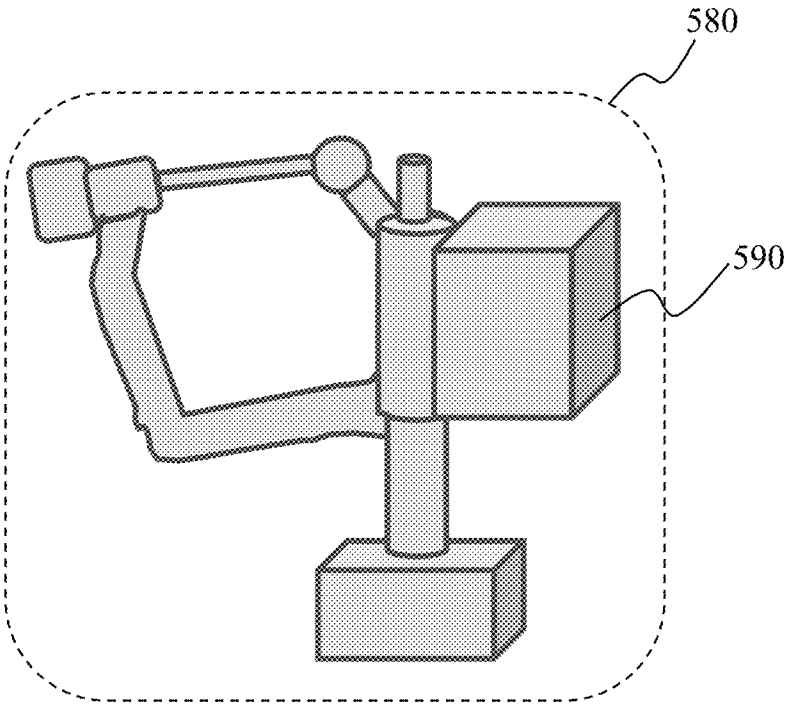
FIG. 5C illustrates an oarlock attached with an exemplary oarlock sensor, in accordance with an exemplary embodiment of the present teaching.

According to the present teaching, the timings of the "catch" and "finish" ($t_3$ and $t_4$, respectively), are determined through a sensing mechanism installed at the oarlock. An oarlock is a mechanical locking mechanism installed at the meeting point of the left and right members (560 and 570) of the rigger to hold in place an oar. FIG. 5B shows an exemplary construct of the oarlock 550 in connection with the left and right members (560 and 570) of the rigger. The oar goes through the opening 550-1. The oarlock 550 has an opening which holds an oar, and the size of the opening may be adjusted using a screwable component 550-2. FIG. 5C illustrates an exemplary enhanced oarlock 580, in accordance with an exemplary embodiment of the present teaching. As seen, the enhanced oarlock 550 include a mechanical locking mechanism similar to 550 and a sensor 590, which is capable of generating different metrics associated with the oar and blade thereof.

Figure 5D:
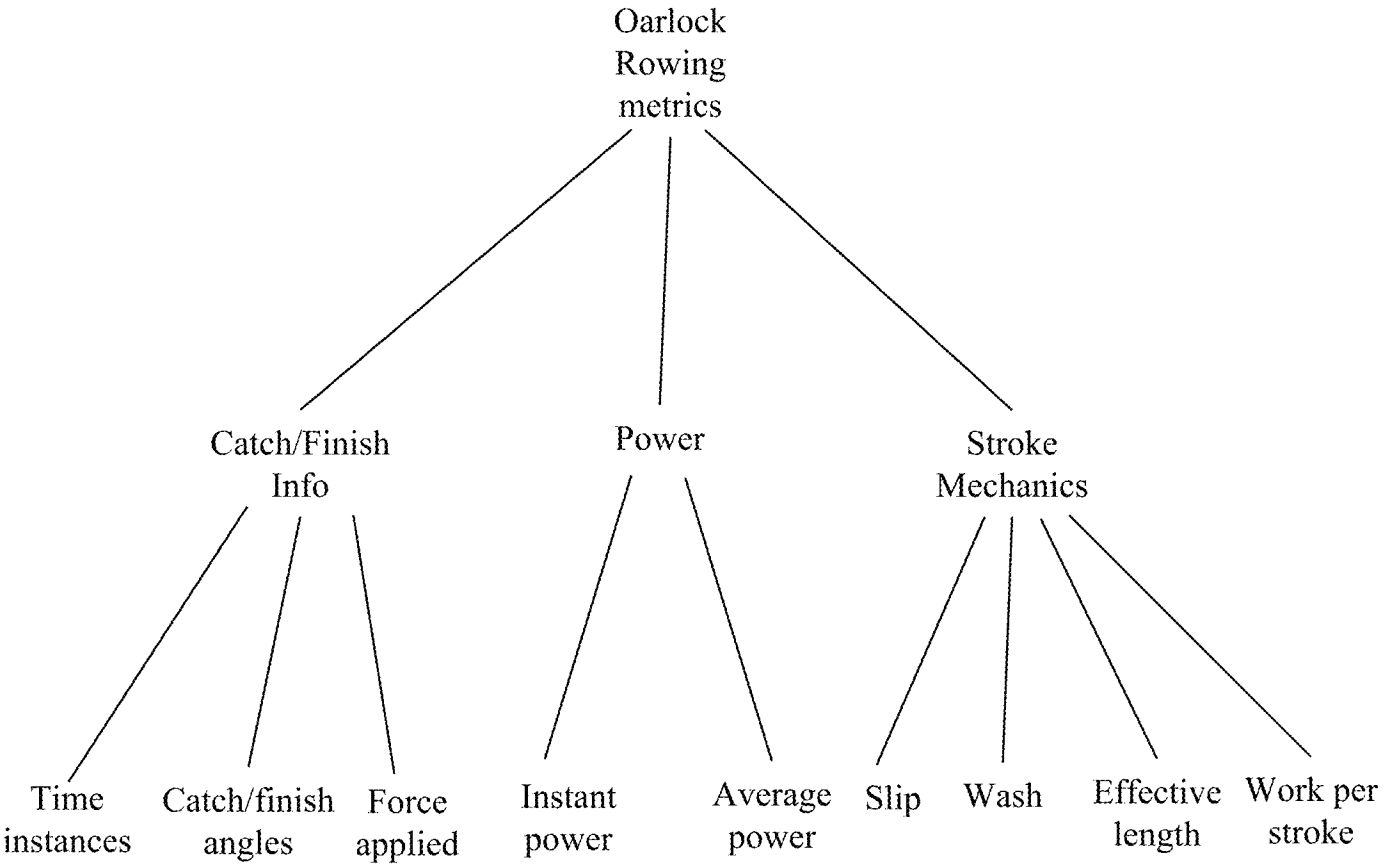
FIG. 5D shows different types of metrics that an oarlock sensor is capable of provide in dynamic situations.

FIG. 5D shows different types of metrics that the oarlock sensor 580 can dynamically provide, including, e.g., information related to "catch," "finish," measures related to power of the oar, and various measurements on each stroke. For example, based on the pressure from an oar, the force applied to the oarlock, the catch angle, the finish angle, which capture the angle of the oarlock at critical points of the stroke such as catch and finish, enabling further analysis of the oar blade entry and exit angles based on, e.g., the rigid spatial relation between the oar and its blade. In some embodiments, based on sudden change in force applied to the oarlock, the timings of the oar blade entering the water (sudden increase of the force on oarlock) or leaving the water (sudden decrease of the force on oarlock) may be estimated. From the sensed force as applied to the oarlock, the power of the stroke may also be measured, either in the form of instance power or in the form of average power measured over time. In some implementations, the force applied to the oarlock may be recorded throughout the stroke to provide insights about the power generation and stroke consistency. An enhanced oarlock may also be configured to provide metrics related to the stroke mechanics such as slip (water resistance during the stroke), wash (amount of water displaced at the finish), effective length (total degrees traversed by the oarlock between some range), maximum/peak force, peak force angle (the angle when reaching peak force), or work per stroke (force times the length of the stroke, which measures the effectiveness of each stroke). The metrics from the enhanced oarlock provide detailed observations with regard to different aspects of each stroke and they can be used for different purposes, including both deriving the timings ($t_3$ and $t_4$) for "catch" and that for "finish" as well as for facilitating rowers or coaches to analyze the data related to individual rowers and come up with personalized practice guide to further improve the performance of respective rowers.

Based on the timings of the landmark events estimated according to the present teaching, such obtained real-time timings of these events may be compared with a synchronization timing instruction for synchronization purpose to determine the synchronization performance of the rowers. In rowing sport, a coxswain decides, on-the-fly, the stroke per minute (SPM) based on different factors, including the goal of the competition, the race strategy, the current fitness level of the crew members, the real-time condition of the water, and the dynamic feedback from the rower members. In general, stroke rate may fall in the range of 28-36. The race strategy can be to have a higher stroke rate at the beginning of a race, a lower rate for sustained power in the middle of the race, and a high rate of when it is near the finish line. The real-time water conditions may include, e.g., calm water (which makes it possible to have a higher stroke rate), choppy water (where a lower rate may be more efficient), etc. The coxswain may also rely on feedback from rowers to adjust the stroke rate. For instance, the coxswain may feel the boat at a set stroke rate and adjust based on, e.g., what is observed, current strengthen of the rowers, and the estimated fatigue level of the rowers. The present teaching provides not only the means for assisting the crew members on a boat to synchronize their actions in accordance with a synchronization timing instruction at different landmark locations in each cycle but also effective feedback to coxswain in terms of how the crew members, either individually or in collection, react to the set stroke rate.

Figures 6A, 6B:
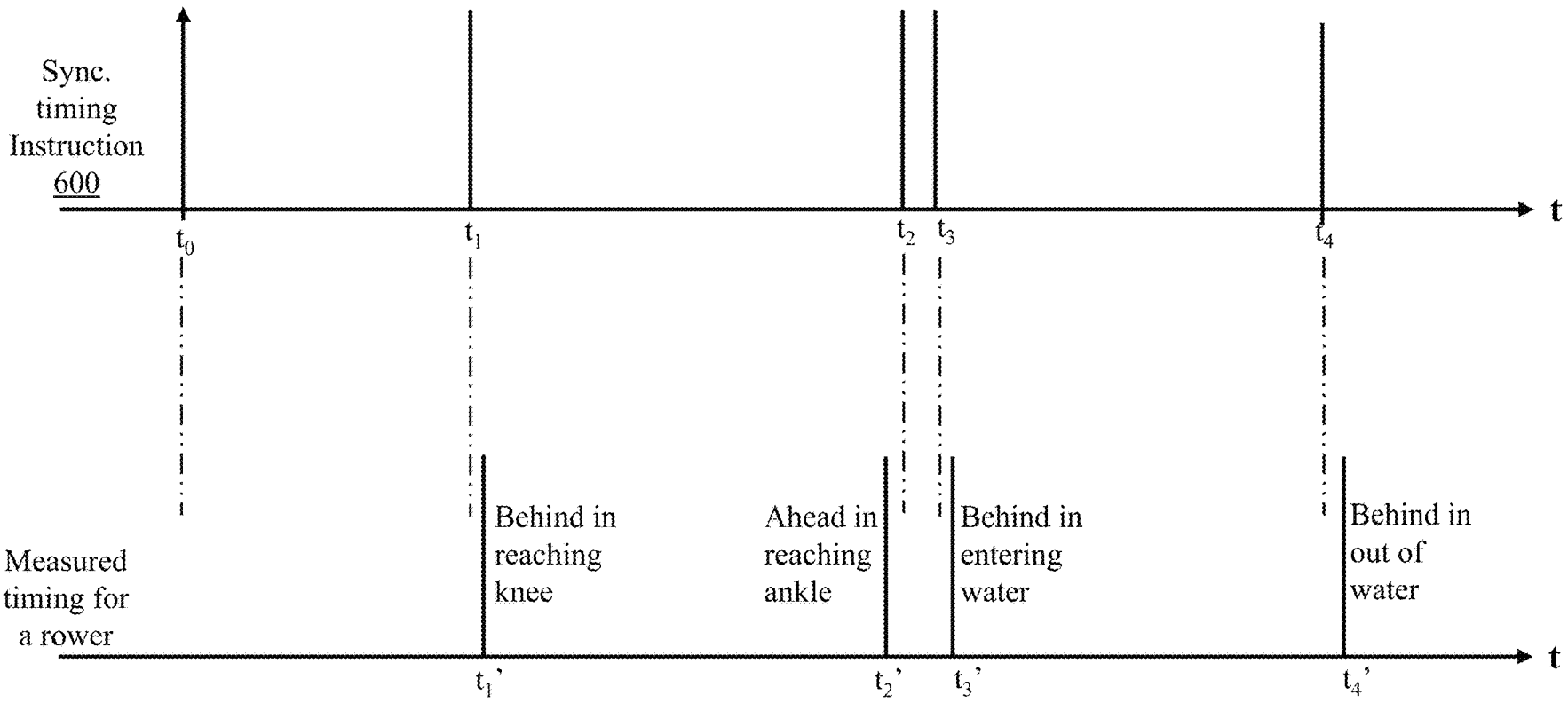
FIG. 6A depicts an exemplary synchronization timing instruction with respect to different events, in accordance with an embodiment of the present teaching.
FIG. 6B illustrates exemplary detected timings of different relevant events, in accordance with an embodiment of the present teaching.

Given a stroke rate, e.g., 30 strokes per minute, the duration of each stroke can be determined. As such, a synchronization timing instruction for each stroke cycle may be generated. In some situations, the specific duration between adjacent timings for each of the events (oar passing the knee, oar passing the ankle, catch, and finish) may be determined based on, e.g., available guidelines in the sport, the experience of the coxswain, or based on known practice data related to the crew members. FIG. 6A depicts an exemplary synchronization timing instruction 600 with timings with respect to different events, in accordance with an embodiment of the present teaching. It is noted that the proportion of each duration between adjacent timings as seen in FIG. 6A is merely for illustration and may not reflect the actual situation in the sport. The exemplary synchronization timing instruction 600 starts with to, and then provides subsequent timings on $t_1$ (for the event of an oar passing the knee), $t_2$ (for the event of an oar passing the ankle), $t_3$ (for the "catch" event), and $t_4$ (for the "finish" event).

FIG. 6B illustrates exemplary detected timings of these events, in accordance with an embodiment of the present teaching. As discussed herein, the timings for the events of an oar passing the knee and the ankle are detected using sensors 320 and 330 that are securely deployed and the timings for "catch" and "finish" are obtained from the enhanced oarlock 580. The detected timings for these events are denoted by $t_1'$, $t_2'$, $t_3'$, and $t_4'$, as shown in FIG. 6B and they may not align with the instructed timings. As illustrated, $t_1'$ is behind of $t_4$, i.e., the rower is late in reaching the knee; $t_2'$ is ahead of $t_2$, i.e., the rower is earlier in reaching the ankle; $t_3'$ is behind of $t_3$, i.e., the rower is late in reaching the "catch"; ta' is behind of $t_4$, i.e., the rower is late in getting the blade out of the water. Any discrepancy indicates asynchronous action and can be determined as $\Delta=t_i'-t_i$, $1\leq i\leq 4$.

Figure 6C:
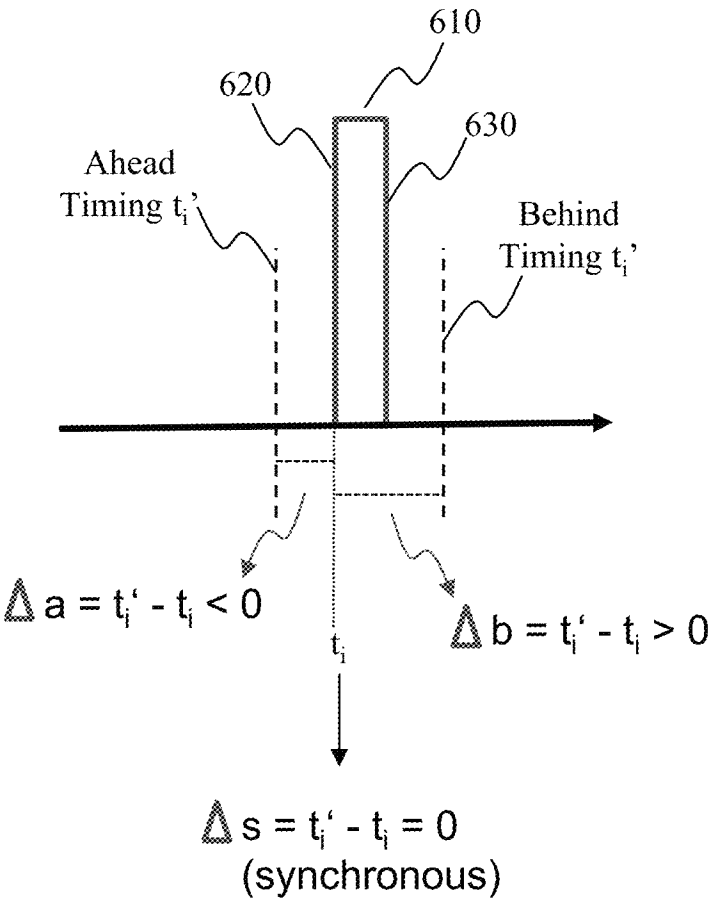
FIG. 6C illustrates the determination of discrepancy of detected timings from instructed timings on an exemplary relevant event, in accordance with an embodiment of the present teaching.

FIG. 6C illustrates an exemplary scheme to determine the discrepancy between detected timings and instructed timings, in accordance with an embodiment of the present teaching. An instructed timing $t_i$ related to an event may be represented as a pulse 610 with a rising edge 620 and a falling edge 630, as shown in FIG. 6C. In some embodiments, any deviation from the instructed timing may be determined with respect to one of the edges, e.g., the rising edge 620. The detected real-time timing $t_i'$ may be synchronized with, ahead, or behind of $t_i$, depending on whether $\Delta=t_i'-t_i=0$, $\Delta=t_i'-t_i<0$, or $\Delta=t_i'-t_i>0$, as shown in FIG. 6C. Given a synchronization timing instruction as shown in FIG. 6A, if a sensor sends a detected timing of an event (e.g., a timing when an oar passing the knee from sensor 320, or a timing of a "catch" event from an oarlock 580) before the instructed timing as specified in the timing instruction, then the synchronization status is "ahead." If at an instructed timing (e.g., $t_2$ for event "oar passing the ankle" or $t_4$ on event that the oar leaves water), no actual timing on the event is received from the sensor designated to monitor, then the synchronization status is "behind." The specific degree of deviation on each event may be computed based on the timing of the event specified in the synchronization timing instruction and the actual timing received from a sensor designated to monitor the occurrence of the event (whether received before or after the instructed event time). The detected synchronization statuses may be delivered to respective rowers to help each to adjust in the next cycle to synchronize with the instructed timings. The degree of deviation relating to each synchronization status may be recorded so that each rower or coach may access at a later point to, e.g., determine how to further improve performance in future practice, as will be discussed below.

As discussed herein, while the synchronization at "catch" ($t_3$) and "finish" ($t_4$) points may be the most relevant to the performance of the rowboat, the synchronization at $t_1$ and $t_2$ is for helping a rower to build up the rhythm towards "catch" to improve the likelihood of synchronization at $t_3$. As such, the instructed timings for the events built up prior to "catch" at $t_1$ and $t_2$ may be personalized based on different considerations. For example, due to different physical characteristics and/or different rowing habits, some rowers may take different lengths of time to reach a certain landmark event (e.g., passing the knee) even when they can actually successfully synchronize on "catch." Given that, it may make sense to obtain personalized synchronization timing instructions for different rowers on events during the "recovery"

phase, while maintaining the identical timing instruction on "catch" and "finish." Such personalized timing instructions for different rowers may be established based on, e.g., performance data collected from past races or practices in which the rowers achieved synchronization on "catch." Based on such data, the personalized durations of each rower between to and $t_1$ as well as between $t_1$ and $t_2$ may be analyzed, e.g., against different stroke rate, and the analysis result may be used to obtain personalized timings for recovery event for each rower under different stroke rates. Such personalized preferences may be stored and applied to generate personalized synchronization timing instructions when a stroke rate is provided.

Figure 6D:
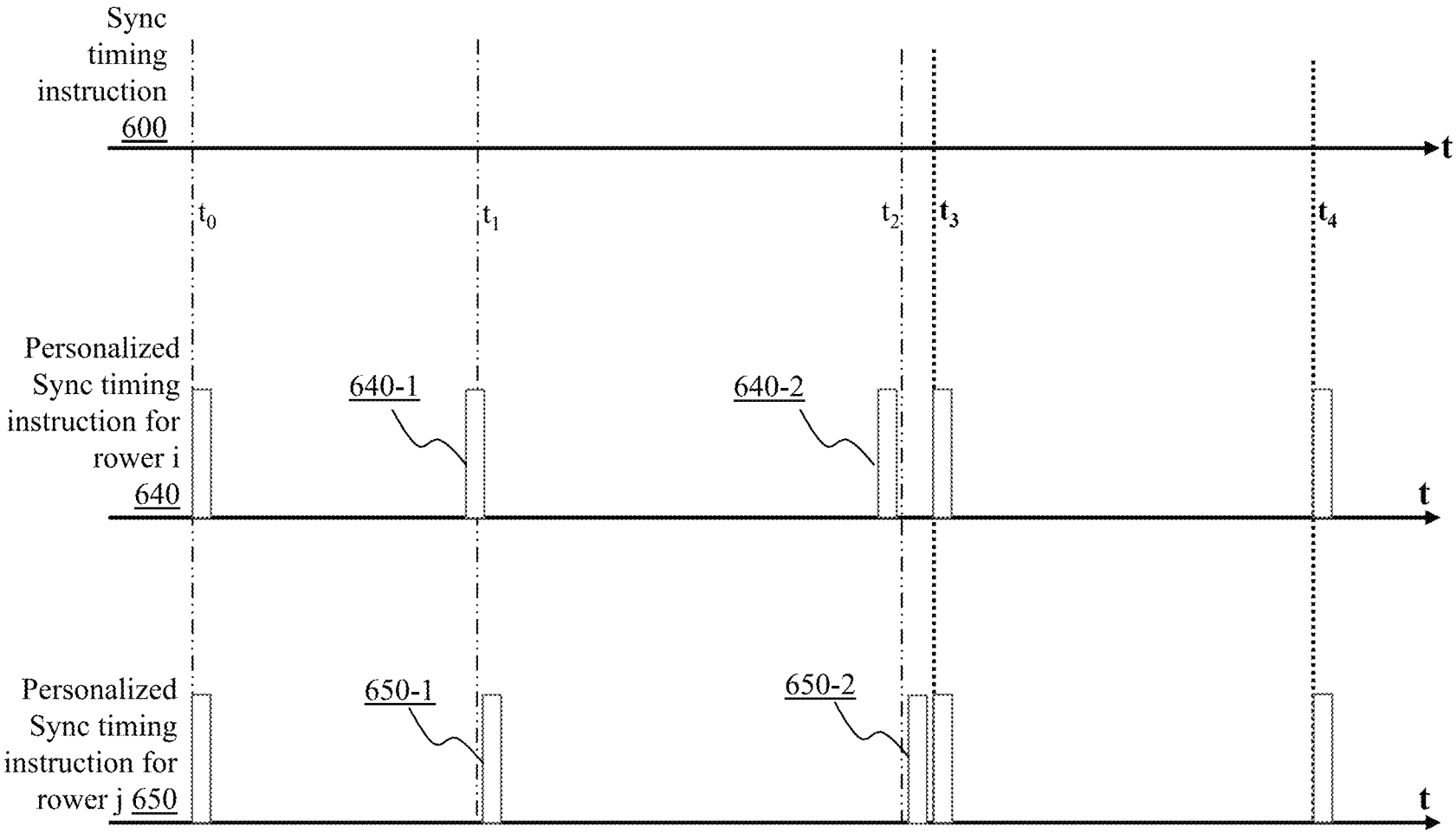
FIG. 6D shows different personalized synchronization signaling instructions to individual rowers, in accordance with an exemplary embodiment of the present teaching.

FIG. 6D shows different personalized synchronization timing instructions for individual rowers, in accordance with an exemplary embodiment of the present teaching. In this illustration, a synchronization timing instruction 600 may be generated based on a stroke rate determined by a coxswain. Based on this stroke rate, there two different personalized synchronization timing instructions 640 and 650 may be customarily generated for rower i and rower j. As seen, the instructions 640 and 650 have the same timing instructions with respect to "catch" ($t_3$) and "finish" ($t_4$) but different timing instructions on the event of oar passing knee ($t_1$) and the event of oar passing the ankle ($t_2$). For rower i, the timings for passing the knee and ankle are consistently slightly earlier than what is regulated by instruction 600 because rower i may be faster in reaching the knee and ankle while the rower i was able to synchronize on "catch" in past performances. For rower j, the timings for passing the knee and ankle are consistently slightly later than what is regulated by 600 because rower j may need a longer time to reach these two landmark events even when the rower j was able to synchronize on "catch" in past performances.

Figure 6E:
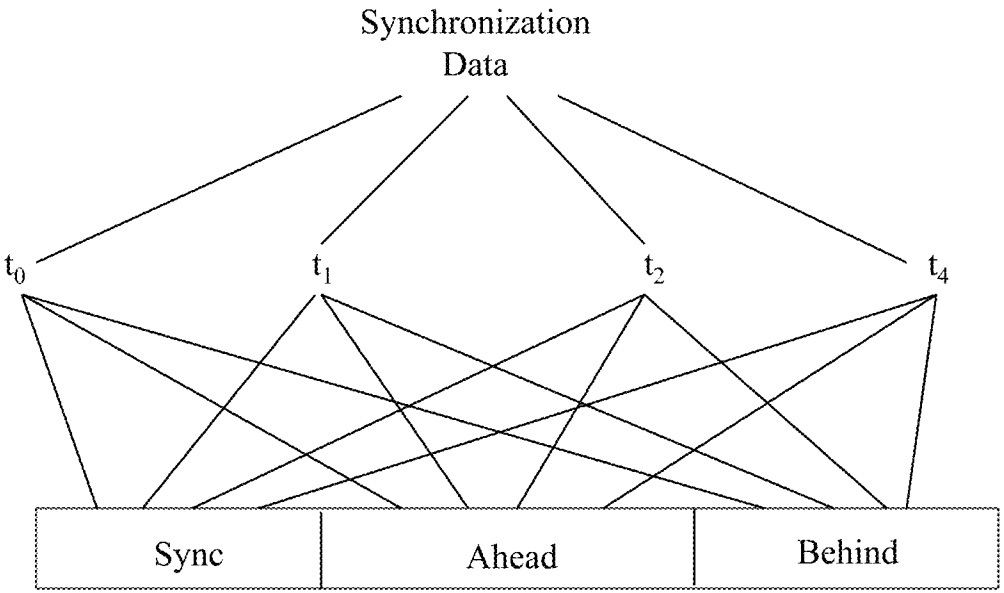
FIG. 6E illustrates different types of synchronization signaling types, in accordance with an embodiment of the present teaching.

With the synchronization mechanism according to the present teaching, each rower may be individually monitored with respect to each of the relevant synchronization events on whether he/she is in syn, ahead, or behind of each of the instructed synchronization timings. With respect to each synchronization event, the monitored sync status for a rower may be instantaneously fed back to the rower to facilitate the rower to adjust the action in next cycle when needed. As discussed herein, there are three different sync statuses, i.e., sync, ahead, and behind. Given that, there are different combinations to communicate to a rower on what is the sync status with respect to which synchronization event. FIG. 6E illustrates such combinations, in accordance with an embodiment of the present teaching. As shown, with respect to each rower, the synchronization data collected in each stroke cycle includes the sync status on 4 synchronization events, i.e., oar passing the knee at instructed timing $t_1$, oar passing the ankle at instructed timing $t_2$, catch at instructed timing $t_3$, and finish at instructed timing $t_4$, as well as a sync status associated with each synchronization event, which is one of three possibilities, i.e., sync, ahead, and behind.

In some embodiments, the monitored sync status with respect to each synchronization event may be instantaneously delivered to a rower in a way that is effective, easy to recognize the sync status, and without needing to look at some display screen (which may disrupt the rower's activity) as some traditional solutions do. For example, the sync statuses on different sync events may be delivered to rowers via, e.g., sound or vibration. In some embodiments, the delivery to each rower may be discrete (e.g., without interfering others) and personalized (e.g., each rower may choose the preferred sound or vibration pattern). When a sound is used, each of the four synchronization events at different timings (i.e., $t_1$, $t_2$, $t_3$, and $t_4$) may use a distinct sound so that a rower may readily associated with a particular sync event. In addition, as each of the synchronization events has three possible statues, i.e., in sync, ahead, or behind, each of the statuses may be conveyed to a rower in a distinct way to allow the rower to discern the situation without hesitation on-the-fly. For instance, in some embodiments, some code may be used for each status, such as A for ahead, O for on sync, and B for behind and if sound is used, such code letters may be simply read to the rower. Any other means to convey the status on each event may be used without limitation and may be configured by each individual rower via exemplary means as will be disclosed below.

Figure 7B:
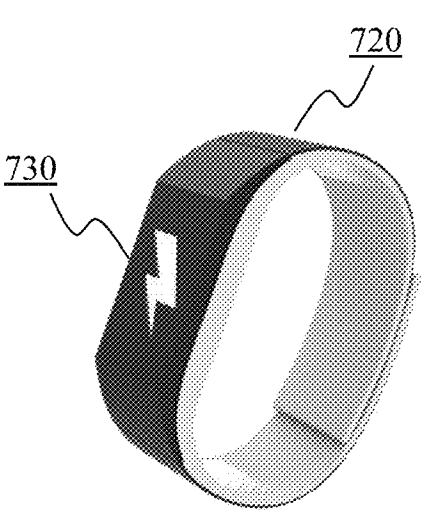
FIGS. 7A-7B shows different rower devices for synchronization purposes, in accordance with an embodiment of the present teaching.
Figure 7A:
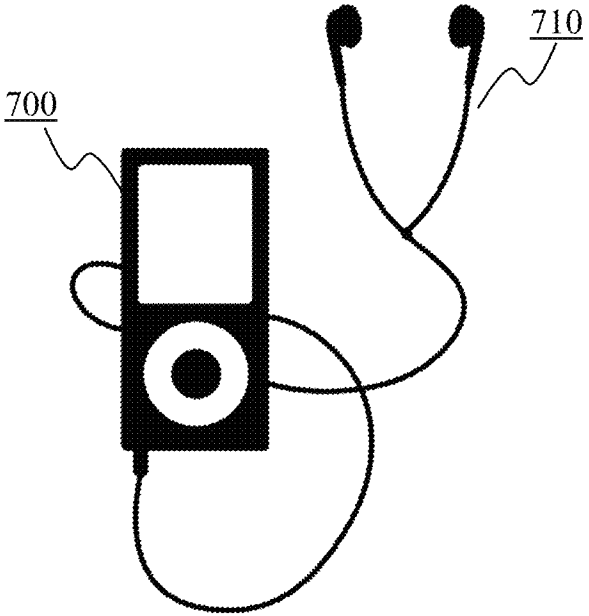

For each rower to receive a synchronization timing instruction for each stroke cycle and be informed of the rower's synchronization status on each of the synchronization events, the rower may be equipped with a light weigh rower communication device to, e.g., elect some personalized ways to monitor the synchronization and certain desired manner to receive the synchronization status report, etc. FIGS. 7A-7B shows exemplary types of a rower device used for synchronization purposes, in accordance with an embodiment of the present teaching. FIG. 7A shows an exemplary rower's device set used by a rower, including a rower unit 700 and/or an earpiece 710. The rower unit 700 may be used for the rower to set up, e.g., via an interface, some operational parameters and to communicate with, e.g., a central unit located on the same rowboat that controls the synchronization operation for the entire crew (discussed below). The earpiece 710 may be worn by each rower and used for receiving and delivering each synchronization timing instruction for a stroke cycle to the rower. In some embodiments, the synchronization timing instruction may be delivered in conjunction with the synchronization status with respect to each event. For instance, a defined beeping tone may be provided at each timing of a synchronization timing instruction and if the rower is ahead, a different tone set up to represent the "ahead" status may be delivered, before the beeping tone, at the time of the actual event (e.g., oar passing the knee) is detected. Similarly, a "behind" status may be delivered using yet another different tone after the beeping tone at the time that the behind event is detected.

FIG. 7B shows an exemplary alternative wearable rower's device 720, which may be worn on a wrist, on an arm, on an ankle, or anywhere else appropriate. The exemplary wearable device 720 may include a user interface 730, through which a rower may set up different personalized preferences, etc., and some components for delivering a timed synchronization timing instruction or synchronization status on each event, such as a speaker for delivering choice of sounds or a mechanism that can be controlled to deliver different vibration patterns. The rower devices as shown in FIGS. 7A and 7B are provided merely for illustration purposes instead of limitation. Any other types of light weight devices that allow a rower to setup preferences, notify the rower a synchronization timing instruction, and deliver the rower's synchronization statuses with respect to different events can be used.

Figure 7D:
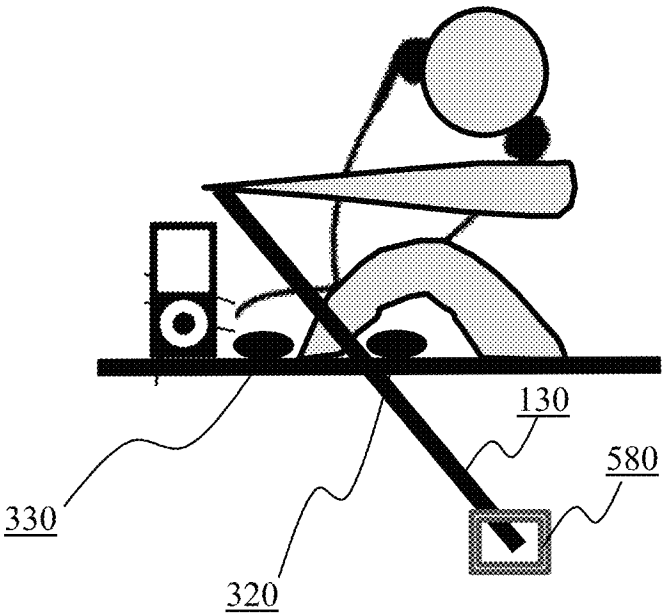
FIGS. 7C-7D shows a rower equipped with a rower unit and sensors to provide detected event timings for synchronization purposes, in accordance with an embodiment of the present teaching.
Figure 7C:
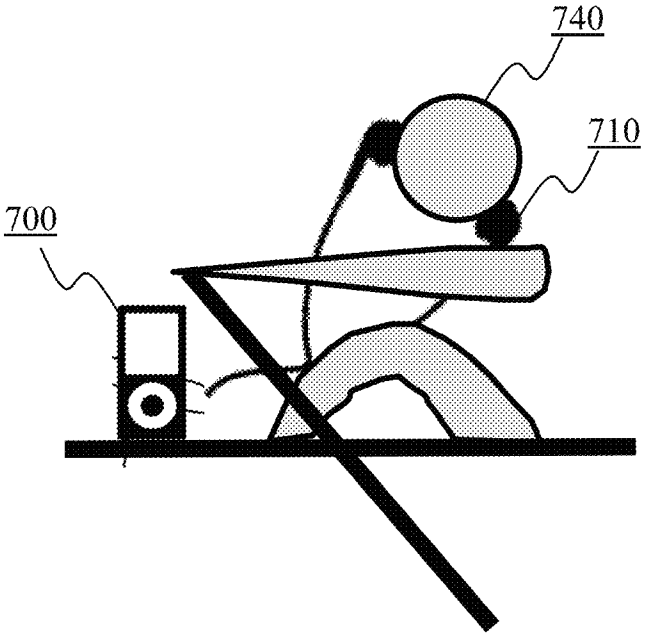
Figure 7E:
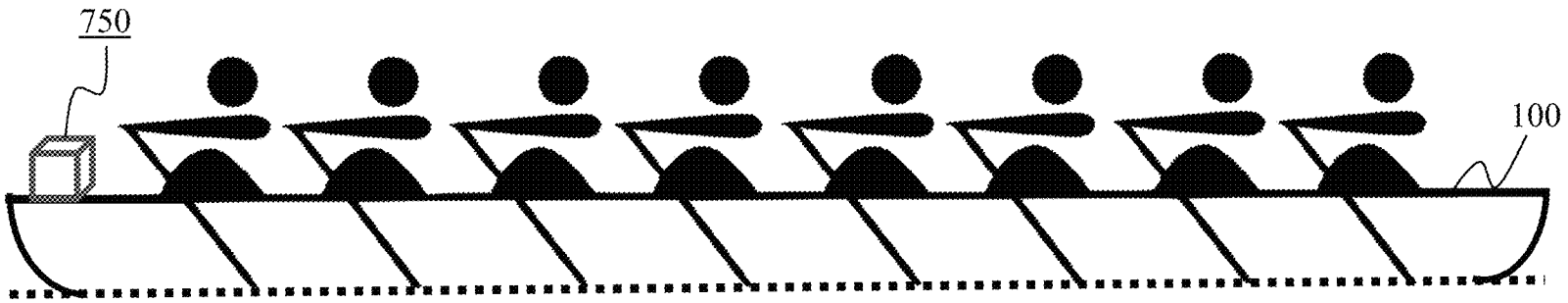
FIG. 7E shows a central unit on a rowboat for controlling synchronization across rowers, in accordance with an embodiment of the present teaching.

FIGS. 7C-7D shows a rower 740 equipped to synchronize on different landmark events in rowing, in accordance with an embodiment of the present teaching. In FIG. 7C, a rower 740 operating with a rower unit 700 and an earpiece 710. Further in FIG. 7D, near the seat of rower 740, an oar 130 is held by the rower and is secured via an oarlock 580 with a sensor 590 therein. To monitor the timings associated with oar 130, sensors 320 (for monitoring the timing when the oar passes the rower's knee) and 330 (for monitoring the timing when the oar passes the rower's ankle) are deployed (in this example, affixed on the boat at appropriate locations). In some embodiments, during rowing, devices and sensors associated with different rowers communicate with a central unit located on the rowboat for controlling and coordinating operations for synchronizing different rowers, recording real-time performance data (e.g., for further analysis), etc. This is illustrated in FIG. 7E, according to an exemplary embodiment of the present teaching. As shown, a rowboat 100 has a plurality of rowers, each of whom is equipped with the rower's device and sensors (now shown in FIG. 7E due to space limit), and a central unit 750 for centrally controlling, among other functions, the synchronization of the rowers' activities to maximize the speed of the rowboat. In some embodiments, the central unit 750 may correspond to an application running on a smart phone of the coxswain on the same boat. In some embodiments, the central unit 750 may also be a separate dedicated device, deployed at some location on the boat 100.

Figure 7F:
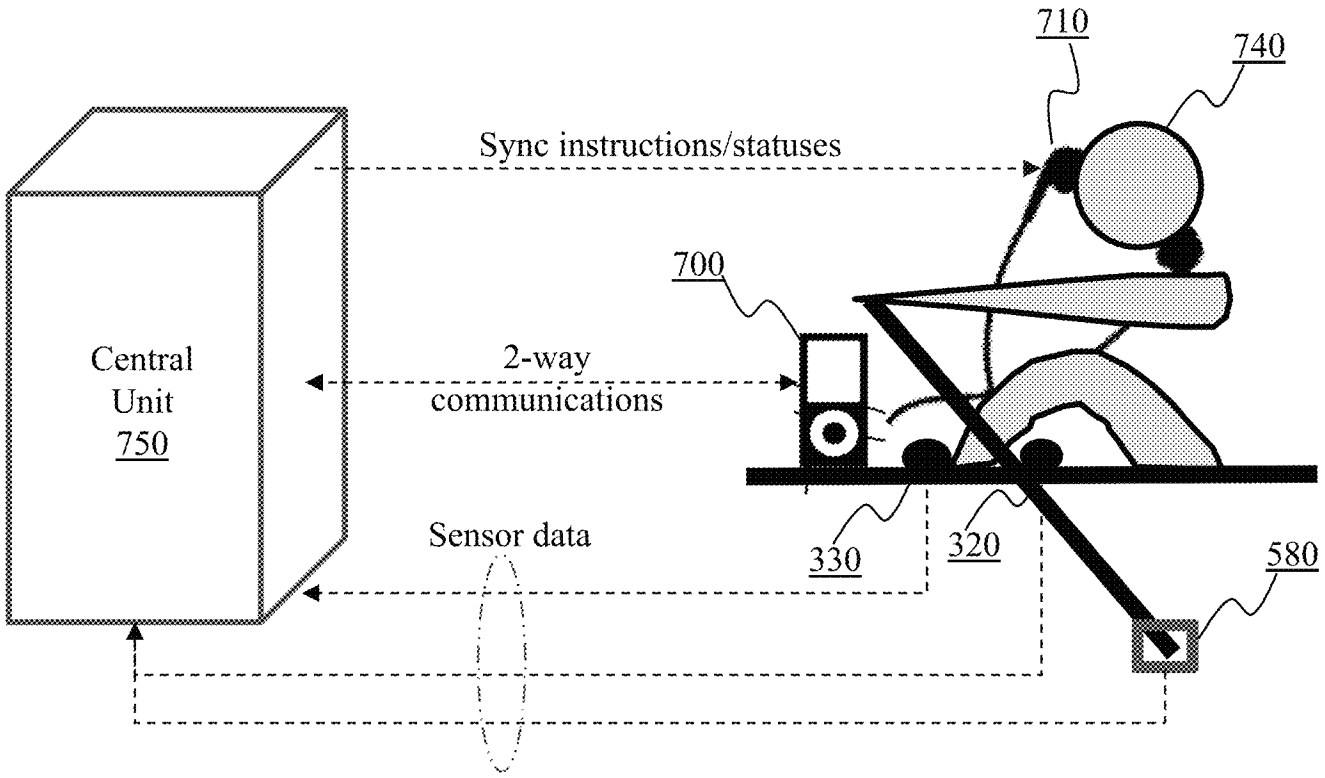
FIG. 7F depicts the wireless communication between a rower unit and sensors of each rower and a central unit on a rowboat, in accordance with an embodiment of the present teaching.

The central unit 750 may be provided for communicating with the coxswain to take an instruction on a desired stroke rate, determining accordingly the synchronization timing instruction for the desired stroke rate, broadcasting the synchronization instruction to rowers' devices, receiving measurements from sensors of all rowers (i.e., timings and metrics), determining discrepancies on different timings associated with each of the rowers, and sending synchronization status reports on such discrepancies to the respective rowers. In some embodiments, the communications between the rowers' devices, sensors, and the central unit 750 are via wireless connections. FIG. 7F illustrates communication channels between the central unit 750, an exemplary rower device 700, as well as sensors associated with a rower 740, in accordance with an embodiment of the present teaching. This exemplary embodiment is illustrated by using the rower unit 700 in combination with an earpiece 710, as discussed with reference to FIG. 7A. The communication channels presented herein can be implemented in the same way using other choices of rower's devices.

As shown in FIG. 7F, when a coxswain sends a desired stroke rate to the central unit 750, it may calculate accordingly the needed synchronization timing instruction and send to the earpiece 710 of rower 740. During each cycle, sensors 320, 330, and 580 may function to collect intended data (timings and metrics) and send to the central unit as sensor data. Based on the sensor data, particularly the timings of different synchronization events related to rower 740, the central unit 750 determines whether discrepancy exists with respect to each event and the type of discrepancy (ahead or behind), generates respective synchronization statuses, and send to the earpiece 710 so that the earpiece 710 may convey the synchronization result back to rower 740. In some embodiments, the synchronization status report may be generated in a personalized manner based on the rower's preferences. This is based on some previous setup that the rower 740 may specify via, e.g., two-way communication with the central unit 750 using the rower unit 700. For example, a rower may specify landmark events to be monitored (e.g., rower 740 may elect not to monitor the event that oar passing the ankle), the beeping sounds signifying different synchronization timings as instructed, and the form of indicating the type of discrepancy (e.g., ahead or behind) if detected. Such personalized parameters may be stored in the central unit 750 and used, in real-time operation, to generate personalized signals for each rower. In some embodiments, the personalized preferences may also be stored on a rower unit 700 so that the central unit 750 may simply send the signaling (e.g., the timing instructions and the synchronization statuses) to a relevant rower unit and the rower unit 700 may generate the version to be delivered to the associated rower according to the preferences specified by the rower and stored on the rower unit 700 before deliver the personalized version of the signaling to the rower.

Whenever the coxswain decides to change the stroke rate based on some consideration, the coxswain may communicate with the central unit 750 so that a new stroke rate is generated and the process repeats. In some implementations, the coxswain may interact with the central unit 750 in the same way as other rowers using a rower unit 700. In other implementations, the coxswain may have a special application running on a device, e.g., a smart phone or a tablet, that the coxswain operates (not shown). In this case, the special application for the coxswain may provide a specialized interface allowing the coxswain to conveniently update the desired stroke rate.

Figure 8A:
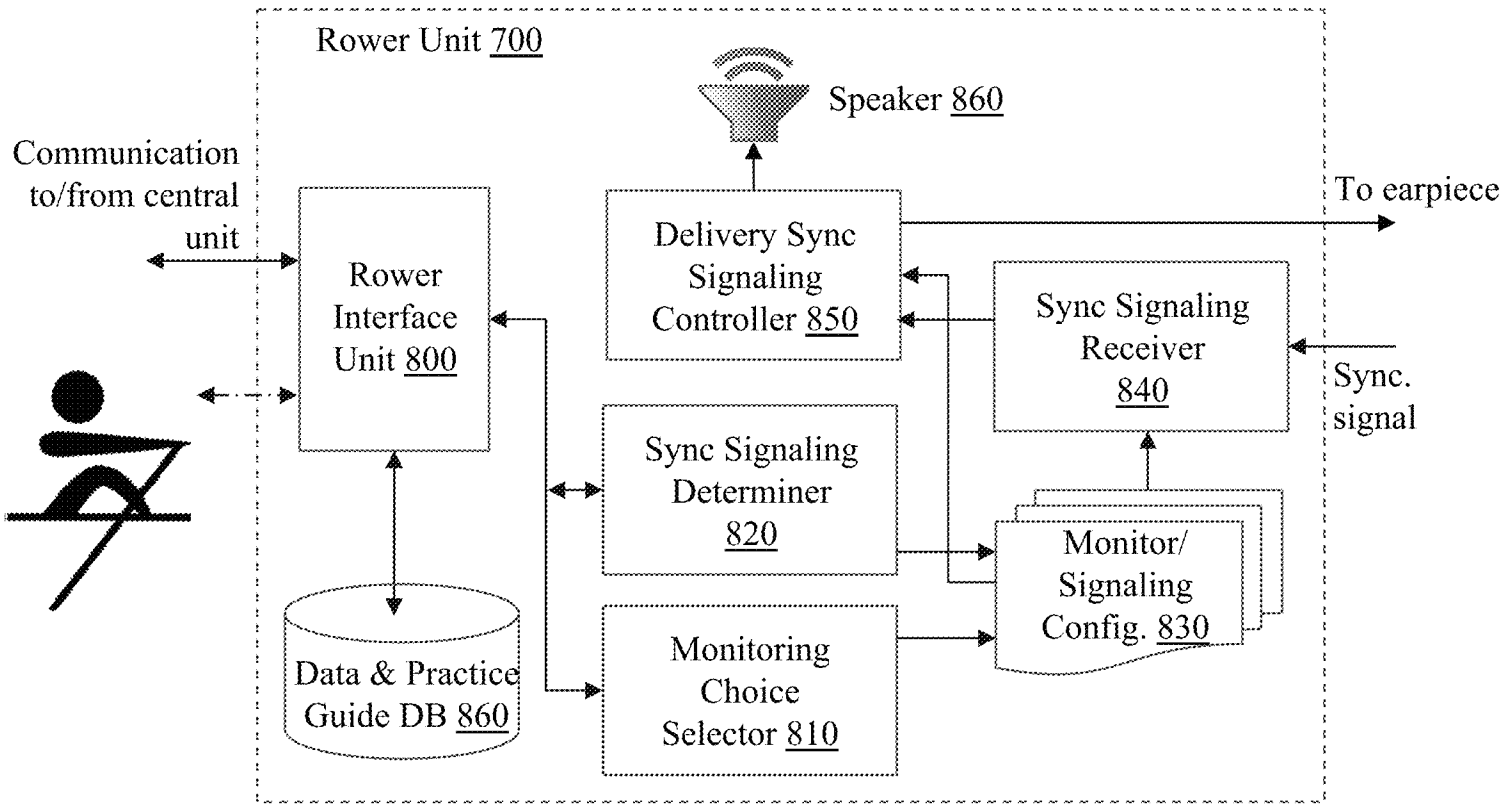
FIG. 8A depicts an exemplary high level system diagram of a rower unit, in accordance with an embodiment of the present teaching.

FIG. 8A depicts an exemplary high level system diagram of the rower unit 700, in accordance with an embodiment of the present teaching. In this illustrated embodiment, the rower unit 700 stores some rower-defined preferences such as personalized choices of events to be monitored and the form of delivering receiving signals (e.g., sound or vibration or specific choice of sounds on each of the events to be synchronized). Such preferences are used to tailor the information received from the central unit 750 to generate a personalized version of synchronization timing instructions (e.g., some of the events may be omitted if a rower choose not to monitor it) and deliver timings and synchronization status on each timing according to rower's selected sounds. In this embodiment, the rower unit 700 comprises a user interface unit 800, a monitoring choice selector 810, a sync signaling determiner 820, a sync signaling receiver 840, and a delivery sync signaling generator 850.

The rower interface unit 800 may provide a conduit for a rower to interact with different modules to perform various functions. For example, through the rower interface unit 800, the rower may interact with the monitoring choice selector 810 to specify, e.g., which of the four landmark events to monitor for synchronization and such preferences may be stored in a monitor/signaling configuration 830 and used in operation accordingly. In addition, the rower may also interact, via the rower interface unit 800, with the sync signaling determiner 820 to specify, e.g., whether a timing instruction from the central unit 750 is to be conveyed via a sound or vibration and/or the specific sound preferred. Such specified preferences are also stored in the monitor/signaling configuration 830 and used to control how the timing instruction and reported synchronization status are to be delivered to the rower in a personalized manner. The monitor/signaling configuration 830 may initially be configured with some default settings, e.g., a specific beeping tone to deliver synchronization timing instructions and different tones for signaling respective synchronization statuses (sync, ahead, behind). Such default settings may be replaced when the rower specify alternatives.

With the specified monitor/signaling configuration 830 (either default or rower replaced settings), when the syn signaling receiver 840 receives a sync signal (which is either a synchronization timing instruction or synchronization statuses on different landmark events), it may generate a modified sync signal based on the received sync signal according to the monitor/signaling configuration 830. For instance, if the rower elected to monitor only $t_1$, $t_3$, and $t_4$ (i.e., skipping $t_2$), then when a timing instruction is received with all four timings (as shown in FIG. 6A), the sync signaling receiver 840 may generate a modified timing instruction with only three timings. In addition, if the rower has specified a specific beeping tone for the instructed timings, the modified time instruction may be annotated at each of the three timings with, e.g., a code indicative of the beeping tone to be used.

Similarly, if the sync signal received is a detected synchronization status, e.g., ahead, the sync signaling receiver 840 may annotate the received sync signal with a code indicating a rower's selected choice (vibration or a sound, and which tone for a sound) on how to notify the rower of the "ahead" status. The sync signaling receiver 840 then sends the modified sync signal to the delivery sync signaling controller 850, which delivers the received sync signal to the rower according to the annotated code on each signaling time. In some embodiments, the delivery may be to activate a speaker 860 to render the specified sound or to vibrate according to rower specified frequency (not shown). In some embodiments, the modified sync signal may be conveyed to the earpiece 710 of the rower. The execution of the delivery may also be carried out based on either a default setting or rower specified personal preferences.

The rower interface unit 8800 may also serve as a conduit for a rower to interact with the central unit 750 to conduct a two-way communication. In some embodiments, the central unit 750 may collect and archive a variety type of data about each rower in each race. Examples of such data may include synchronization related, such as each of the desired stroke rates issued by a coxswain at corresponding locations and times, the synchronization timing instructions generated for such desired stroke rates, and the synchronization statuses of each rower against instructed timings. Such data may also include other metrics related to strokes of each rower, including angles of oar blades when entering and leaving water, force applied to the oarlock, slip, wash, power, work per stroke, and effective length, representing each rower's stroke mechanics throughout the rowing process. Such data may be later analyzed to assess, e.g., a rower's performance to understand strength and existing issues to help to come up with a personalized practice guide for the rower to enhance the competitiveness in training. A rower may interact with the central unit 750 via the rower interface unit 800 to, e.g., examine the data associated with a particular race, request the central unit 750 to create a personal training guide based on what the data reveals, and download such personal training guide to the rower unit 700. In some implementations, the rower unit 700 may be designed to be able to connect with a rowing training machine, input a personal training guide to the rowing training machine, which may accordingly create a training program for the rower aiming at addressing the issues observed in races and strengthening or enhancing the rower's ability in those observed issues.

Figure 8B:
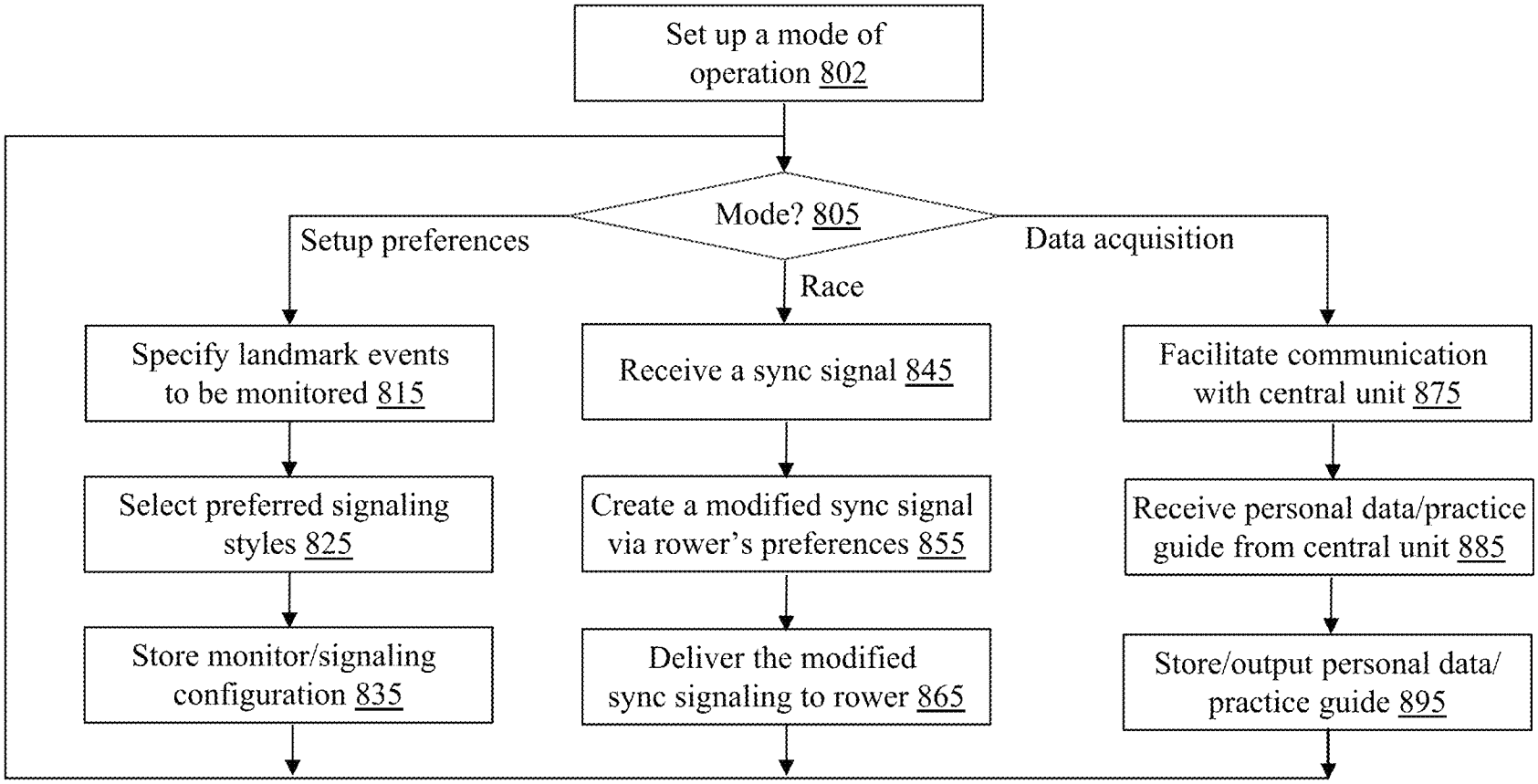
FIG. 8B is a flowchart of an exemplary process of a rower unit, in accordance with an embodiment of the present teaching.

FIG. 8B is a flowchart of an exemplary process of the rower unit 700, in accordance with an embodiment of the present teaching. As discussed herein, the rower unit 700 may function in different modes of operation, including a mode for setting up preferences, a race mode in which synchronization signals are delivered upon receipt according to the set preferences, and a data acquisition mode for channeling communication with the central unit 750 to assist a rower to obtain data from the central unit 750. A rower may first set up, at 802, a mode of operation of the rower unit 700 by interacting with the rower interface unit 800. In operation, it is first determined, at 805, the current mode of operation. If the rower desires to reset personalized preferences, the rower unit 700 facilitates the rower to specify, at 815, the landmark events to be monitored. In some embodiments, some limit may be put in place as to which event that the rower may opt out from synchronization (e.g., "catch" and "finish" cannot be opted out). In addition, the rower may select, at 825, the preferred signaling styles for delivering different sync signals. As discussed herein, a rower may select a certain beeping tone for the instructed timings and different sounds for different synchronization statuses. In some situations, a rower may also specify whether a synchronization timing instruction is to be personalized on some timings based on the rower's past performance data. For instance, if a rower consistently synchronized well on "catch" and "finish" but habitually deviated from instructed timing $t_1$ related to passing the knee, the rower may be allowed to continue the personalized pattern so long as the synchronization on "catch" and "finish" is maintained. Such rower provided preferences may then be stored, at 835, in the rower unit 700 so that they can be applied accordingly.

During a rowing race, the rower may be required to configure associated rower unit 700 in a "race" mode. In this mode of operation, the sync signal receiver 840 receive, at 845, a sync signal (which may be a synchronization timing instruction, detected sync statuses, or a combination thereof for each stroke cycle). The received sync signal may then be personalized, if needed according to the rower specified preferences (stored in monitor/signaling configuration 830), to create, at 855, a modified sync signal, which is then used by the delivery sync signaling controller 850 to deliver, at 865, the modified sync signal to the rower. As discussed herein, during a rowing race, the synchronization timing instructions may represent different stroke rates that change based on dynamic conditions encountered in the race. Thus, in a race mode, the rower unit 700 repeats the steps 845-865 to deliver each received sync signal in a personalized manner to the rower.

As discussed herein, a rower retrieve data collected and archived by the central unit 750 for study or obtain a personalized practice guide created based on data specific to the rower. This may be achieved in the data acquisition mode, in which the rower interface unit 800 may create a conduit between the rower and the central unit 750 to facilitate, at 875, the rower to communicate with the central unit 750. Through such communication, the rower may request personal data or personalized practice guide from the central unit 750. In this case, when the rower unit 700 receives, at 885, the rower requested information, it may store, at 895, the information as requested by the rower in a local database 860 for personal data and personalized practice guide. In some implementations, the rower unit 700 may also be designed to be able to either connect to a peripheral device (e.g., a printer, a USB, or a CD) so that the information from the central unit 750 may also be output to a separate device.

The functionalities of the rower unit 700 as described herein are merely for the purpose of illustrating how it may be used by each individual rower to enhance the rowing skills. The illustrated implementation in FIG. 8A is not intended as a limitation as to how the rower unit 700 may be designed or functioned. Any component incorporated therein may be provided to achieve certain functions that may assist a rower to enhance the rowing skills. Some of the functions as discussed herein and illustratively implemented in the rower unit 700 may also be provided centrally in the central unit 750. In this case, the rower unit 700 may correspond to a simpler communication enabler without other significant functions. For instance, the personal preferences of different rowers may be specified via rower units but stored on the central unit 750. As such, the personalization of the choices of events to be synchronized as well as preferred signaling delivery styles of each rower may be centrally stored so that personalized sync signals to be sent to different rowers may be customized by the central unit 750 according to the centrally stored rowers' preferences.

Figure 9:
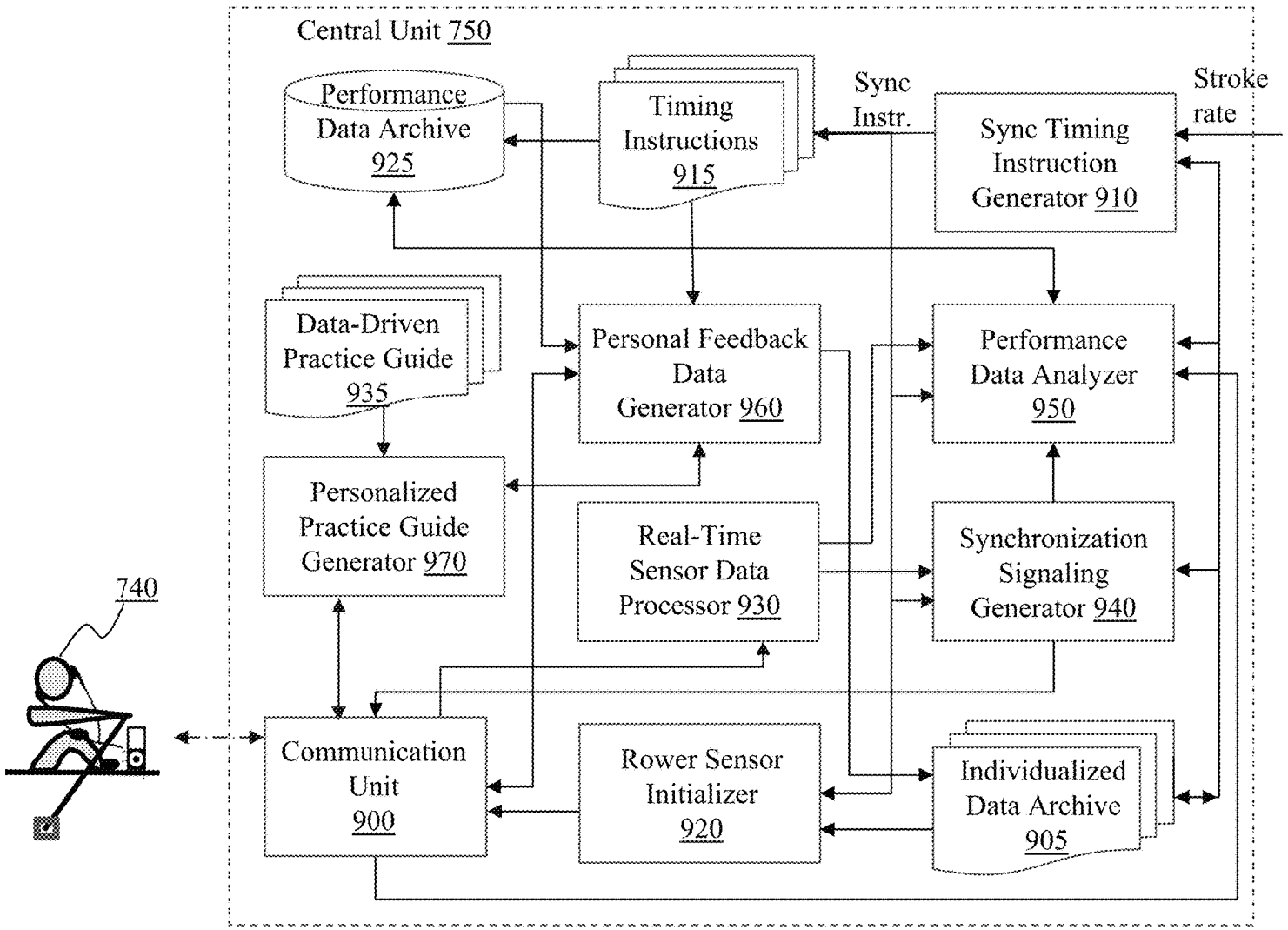
FIG. 9 depicts an exemplary high level system diagram of a central unit, in accordance with an embodiment of the present teaching.

FIG. 9 depicts an exemplary high level system diagram of the central unit 750, in accordance with an embodiment of the present teaching. In this illustrated embodiment, the central unit 750 includes several parts. The first part is the initialization part to set up some rower specific data. The second part is the on-the-fly operation during a race. The third part corresponds to data service. The first part includes a communication unit 900, a performance data analyzer 950, and an individualized data archive 905. The second part includes a sync timing instruction generator 910, a timing instructions storage 915, a rower sensor initializer 920, a real-time sensor data processor 930, a synchronization signaling generator 940, and the performance data analyzer 950. The third part comprises the communication unit 900, a performance data archive 925, a personal feedback data generator 960, a data-driven practice guide 935, and a personalized practice guide generator 970.

As discussed herein, a rower may communicate with the central unit 750 to specify whether a synchronization timing instruction is to be personalized based on the rower's past performance (e.g., with a slightly delayed timing on the event of oar passing the knee due to good synchronization on other timings). This may be done via the first part of the central unit 750. In some embodiments, the individualized data archive 905 may provide a profile for each rower associated with creating a synchronization timing instruction for each rower. Initially, a profile for each rower may correspond to a default profile, indicating that no personalization, e.g., generating a sync timing instruction with timings in a standard manner (e.g., as 600 in FIG. 6D). A rower may specify to the central unit 750 (via a rower unit 700 as discussed previously) to personalize some of the timings of a synchronization timing instruction based on the rower's past performance data (see examples 640 and 650 as shown in FIG. 6D). This may cause the communication unit 900 to invoke the performance data analyzer 950 to retrieve past performance data, analyze it, and update the individual timing information in 905 so that it may be used to personalize the timing(s) on certain monitored event(s) as specified.

During a rowing race, the second part of the central unit 750 operates to support the on-the-fly synchronization according to stroke rates as dynamically provided by the coxswain, collection of real-time performance data, and performance analysis and data archive. When a stroke rate is received by the sync timing instruction generator 910 generates accordingly synchronization timing instructions based on generation profiles for rowers as specified in the individual data archive 905, as discussed herein (see different sync timing instructions for different rowers in FIG. 6D). Such generated timing instructions are stored in 915 for future performance analysis and are also sent to different modules to start the synchronization under a new stroke rate. As shown in FIG. 9, a standard synchronization timing instruction (e.g., 600 in FIG. 6D) may be sent to the rower sensor initializer 920, which, upon receiving the timing instruction, may proceed to reset, via the communication unit 900, all sensors associated with all rowers to start the synchronization under a new stroke rate and forward each rower the synchronization timing instruction intended therefor. Under each stroke rate, a synchronization timing instruction controls the length of each stroke cycle so that the instruction to each rower may be used repeatedly in subsequent cycles until a new timing instruction is applied to adapt to a new stroke rate.

In each stroke cycle, data monitoring the timings of different events of different rowers are transmitted by the sensors wirelessly and received by the communication unit 900. The received sensor data associated with each rower may be signified with a rower's identity. The real-time sensor data processor 930 may analyze the received data with respect to each timing of each rower and send the analysis results to the synchronization signaling generator 940. As illustrated in FIGS. 6A-6B, to determine the synchronization status on each timing, the synchronization timing instruction 600 as well as measured timing from different sensors may be compared to determine whether a rower is in sync, ahead, or behind the instructed timing. Upon receiving the measured timing information from the sensors, the synchronization signaling generator 940 compares each measure timing of each rower with the corresponding instructed timing on the same event to generate a synchronization signaling, which is then fed back to the rower (via the rower unit 700 and, e.g., the earpiece 710) to assist the rower to be synchronous with the instructed timings on different event in each stroke cycle. In addition, the comparison results on the timings of monitored event of each rower are sent to the performance data analyzer 950, which may pair the comparison results with the specific timing instruction associated with a rower, a race, a location, and a time of day and save such relevant data in the performance data archive 925 for future use.

The performance data archived in 925 may include real-time data collected from multiple races and the data stored therein may be accessed with respect to different rowers, races, locations of the races, season of the races, to facilitate different types of analysis to support the generation of different training or practice strategies or guidelines. As illustrated herein, the central unit 750 may be implemented as an application on a smart phone or a tablet. In some implementations, the performance data archived in 925 may be downloaded to a more significant computer when needed for further data analysis at a larger scale. The archived performance data based on real data from races/practices may be used to spot strong performance aspects or remaining issues with respect to different conditions, e.g., rowers, type of races, locations of races, or even coxswains. Such understanding of the data may also be leveraged to create directed and personalized practice guide to individual rowers to assist them more effectively target the aspects in their past performance that require improvement.

As discussed herein, the third part of the central unit 750 is for providing such data related services. A rower may interact with the communication unit 900 (via the rower unit 700) to make different data related service requests. For example, a rower may request performance data related him/her in some specified races. The rower's request may be routed to the personal feedback data generator 960, which may retrieve, based on the specified criteria (the rower's identify, and specific races), the performance data archived in 925 as well as the timing instructions used to perform synchronization in the specified races. In some embodiments, in addition to retrieving archived information from 925 and 915, the personalized feedback data generator 960 may also be provided to analyze the retrieved data in order to provide some analytics of the rower's choices. For example, the personalized feedback data may also include analyzed information, e.g., the average synchronization discrepancies on each of the synchronization events in each race or across different races (e.g., a rower may be consistently synchronous on passing the knee but then behind on "catch" event), the excellent average power applied to the blade while in water, and undesirable angles of blade when entering water that caused issues, etc.

A rower may also request the central unit 750 to create, based on certain performance analytics, a personalized practice guide that can help the rower to, e.g., train certain muscle in a different way to overcome issues observed, add specific type of exercises for the arms to increase the power applied to the stroke, or follow a program to speed up the body movement to meet the synchronization at higher stroke rates, etc. In this case, the request for a personalized practice guide may be routed to the personalized practice guide generator 970, which may invoke the personalized feedback data generator 960 first to gather relevant data analytics and then accordingly personalizes the practice guide based on knowledge stored in data-driven practice guide 935, which may pair certain issues observed with corresponding practice tips to address the issues. Such generated personalized practice guide may be sent to the rower unit 700 to allow the rower to conduct their practice according to the recommended program.

Figure 10A:
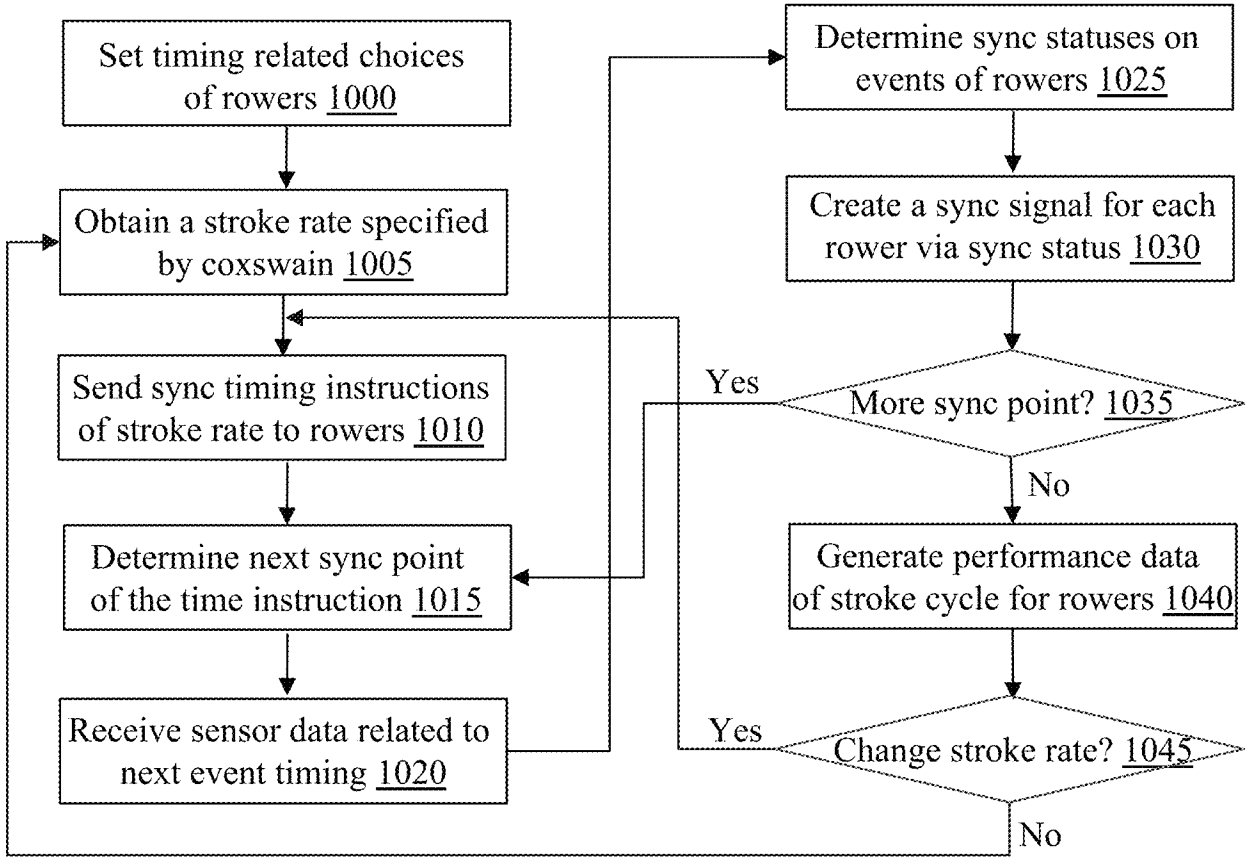
FIG. 10A is a flowchart of an exemplary process of a central unit to synchronize rowers' strokes, in accordance with an embodiment of the present teaching.

FIG. 10A is a flowchart of an exemplary process of the central unit 750 to synchronize rowers' strokes, in accordance with an embodiment of the present teaching. As discussed herein, via the first part of the central unit 750, choices of different rowers in terms of whether the synchronization timing instruction is to be personalized may be specified and set at 1000. When the central unit 750 receives, at 1005, a stroke rate from a coxswain, synchronization timing instructions for different rowers are generated according to the individually set preference choices and sent, at 1010, to the respective rowers. As discussed herein, each synchronization timing instruction includes multiple timings at corresponding sync points, each of which requires synchronization. At the next sync point (e.g., $t_1$) as determined at 1015, sensor data (timings) related to the corresponding event (e.g., timing of oar passing the knee) is received, at 1020, from sensors for the respective rowers. Such data (timing) from a sensor related to each rower is then compared with the synchronization timing instruction (as shown in FIGS. 6A-6B) on the same sync event to determine, at 1025, a sync status with respect to the corresponding event (e.g., sync, ahead, or behind, as illustrated in FIG. 6C), which is then used to create, at 1030, a sync signal for signaling the rower as to the performance at this synchronization point. As discussed herein with reference to FIGS. 8A-8B, such a sync signal is to be used to generate individualized signaling as specified by each rower to convey the synchronization status.

When more sync event within the same cycle remaining, determined at 1035, the process returns to step 1020 to proceed to synchronize the next sync event. When all sync events in a stroke cycle are completed (e.g., at timing $t_4$), determined at 1035, the sensor data received within this stroke cycle may be used to generate, at 1040, performance data of each rower with respect to this stroke cycle. This is because at this point, the sensor data received within the same stroke cycle also includes, in addition to synchronization data, metrics related to stroke mechanics (e.g., sensor data received up to $t_4$ may include angles associated with "catch" and "finish", power applied to the oar while in water, slip, wash, etc.). Such metrics, together with the synchronization statuses on different sync points, may be assessed with respect to each rower to generate the performance data related to each rower on the stroke cycle. As shown in FIG. 9, such performance data for each rower in each stroke cycle of a race may be stored in the performance data archive 925 in connection with the current stroke rate.

If there is a change in stroke rate, determined at 1045, the process proceeds to step 1005 to obtain the new stroke rate and then steps 1010-1045 are repeated for the operation with respect to stroke cycles related to the next stroke rate. If there is no change in stroke rate, this means that the same stroke rate applies, i.e., the next stroke cycle will be based on the same stroke rate. In this case, the process proceeds to steps 1010-1045. The entire process as illustrated in FIG. 10A continues until, e.g., a race completes. At this point, the performance data with respect to each rower on, e.g., synchronization and stroke mechanics, created based on sensor data is generated and stored in the performance data archive 925 and may be used to provide the data services as discussed herein.

Figure 10B:
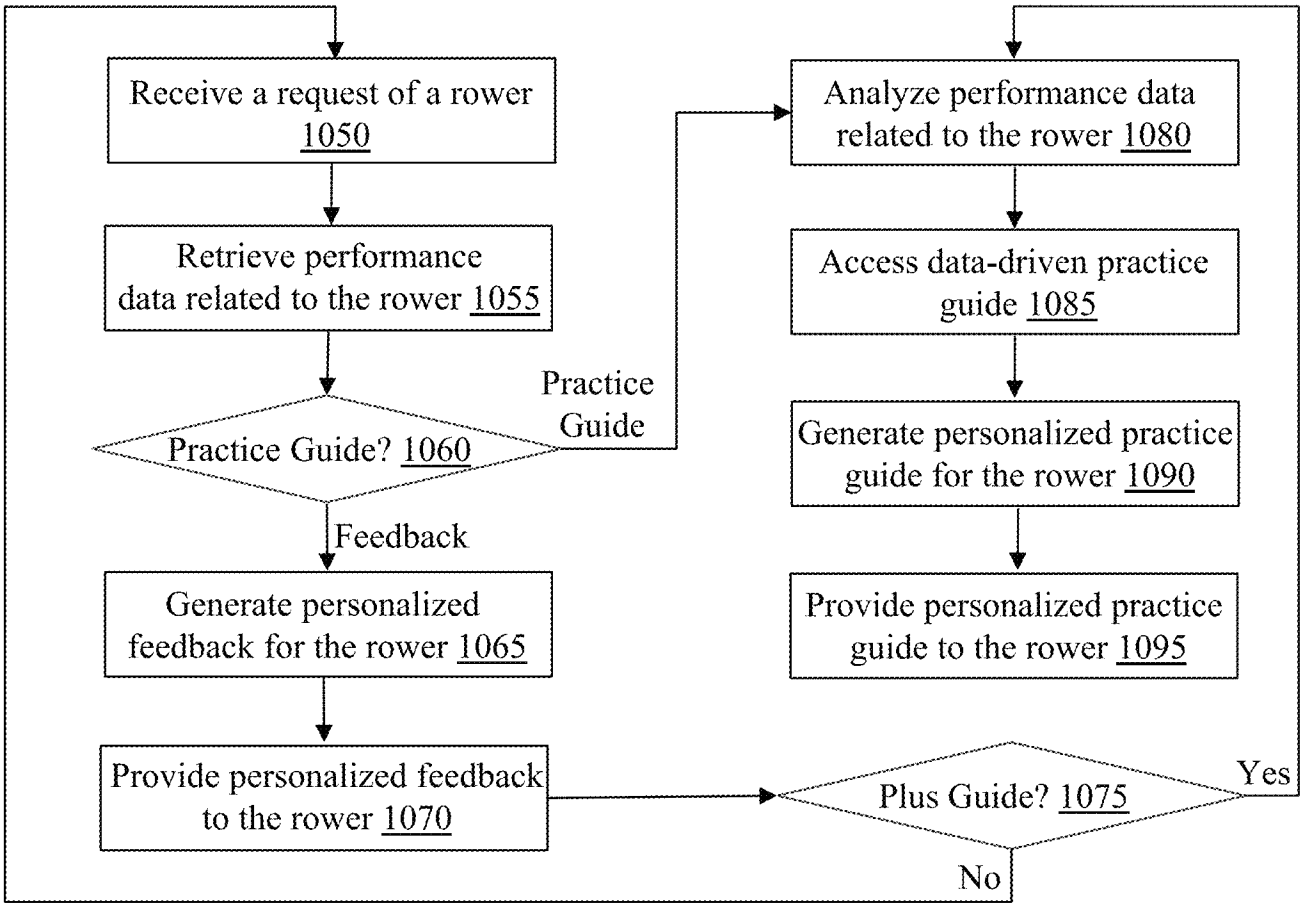
FIG. 10B is a flowchart of an exemplary process of a central unit to provide personalized data services to a rower, in accordance with an embodiment of the present teaching.

FIG. 10B is a flowchart of an exemplary process of the central unit 750 to provide personalized data services to a rower, in accordance with an embodiment of the present teaching. When a request from a rower is received, at 1050, via the communication unit 900, the rower may specify information related to the request, such as the identity of the rower, the nature of the performance data requested (e.g., synchronization related, stroke mechanics related, etc.), the scope of the performance data (e.g., which race(s), what period(s), etc.), etc. Such specified information may be used to retrieve, at 1055, performance data as requested. As discussed herein, the exemplary data services may include, e.g., personalized feedback on a rower's performance, a personalized practice guide generated based on the performance data related to the rower, or the combination thereof. Depending on the specific type of request (e.g., merely retrieve the performance data for study, a personalized practice guide, or the combination), appropriate processing is carried out.

If the request is for personalized feedback on rower's performance, determined at 1060, the central unit 750 generates, at 1065, the personalized feedback to the rower based on the performance data retrieved based on the request, which is then sent, at 1070, to the rower. If the request is to obtain a personalized practice guide or both the personalized feedback and a personalized practice guide, determined at 1060 and 1075 respectively, the process proceeds to step 1080 to analyze the performance data related to the rower in order to derive some metrics that may be relied on to customize the requested practice guide according to, e.g., knowledge stored in data-driven practice guide 935. Exemplary metrics may characterize different aspects of the rower's performance, e.g., average metrics related to synchronization, power, slip, angles, wash, etc. across some past races, correlation of such metrics with respect to different race conditions such as race locations, weather conditions, water conditions, etc. To generate the personalized practice guide, the knowledge stored in the data-driven practice guide 935 is obtained, at 1085, and used to personalize, at 1090, the practice guide for the rower with respect to the rower's performance data and associated metrics obtained therefrom. Such created personalized practice guide is then provided, at 1095, to the rower.

Figure 11:
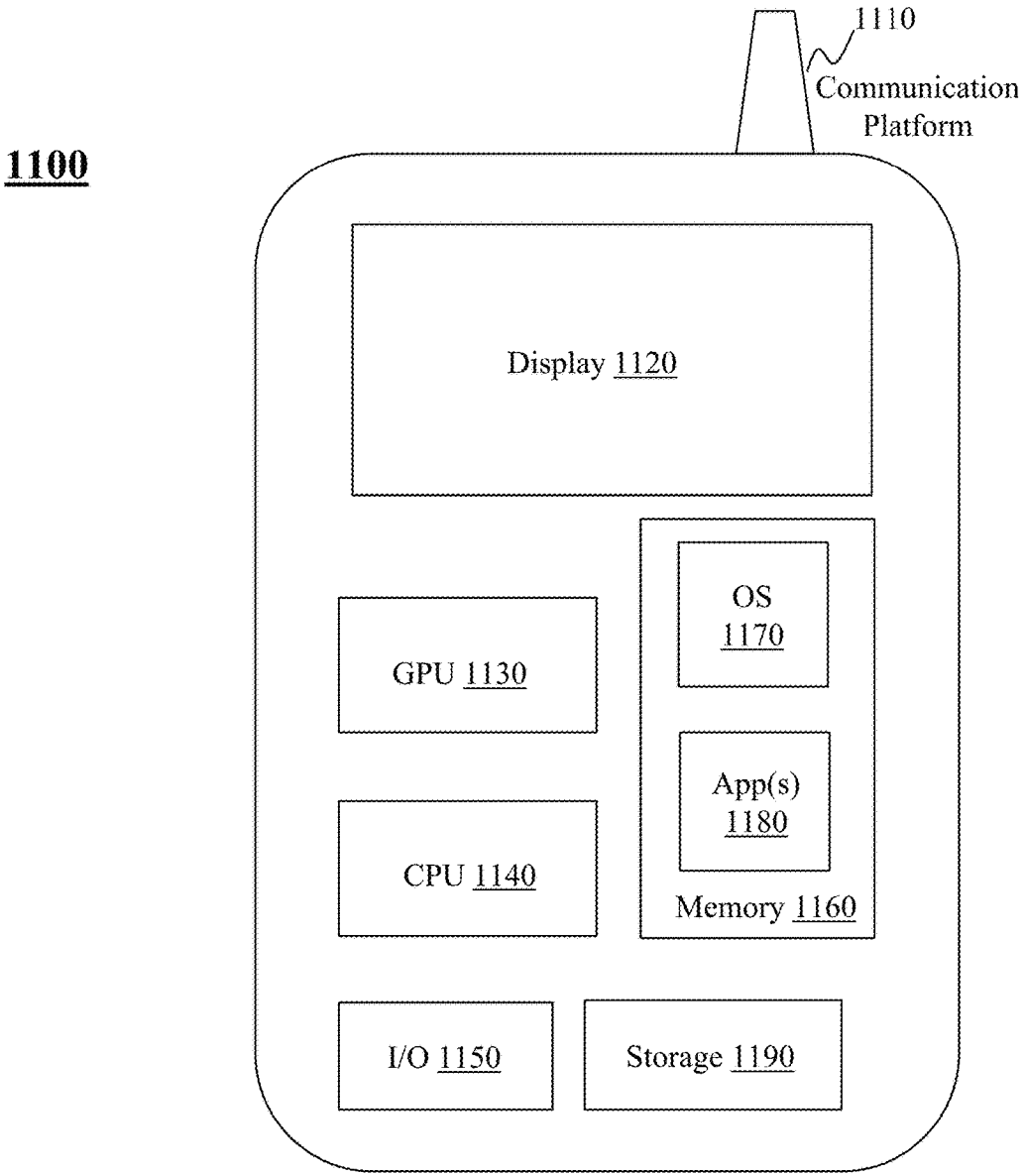
FIG. 11 is an illustrative diagram of an exemplary mobile device architecture that may be used to realize a specialized system implementing the present teaching in accordance with various embodiments.

FIG. 11 is an illustrative diagram of an exemplary mobile device architecture that may be used to realize a specialized system implementing the present teaching in accordance with various embodiments. In this example, the user device on which the present teaching may be implemented corresponds to a mobile device 1100, including, but not limited to, a smart phone, a tablet, a music player, a handled gaming console, a global positioning system (GPS) receiver, and a wearable computing device, or in any other form factor. Mobile device 1100 may include one or more central processing units ("CPUs") 1140, one or more graphic processing units ("GPUs") 1130, a display 1120, a memory 1160, a communication platform 1110, such as a wireless communication module, storage 1190, and one or more input/output (I/O) devices 1150. Any other suitable component, including but not limited to a system bus or a controller (not shown), may also be included in the mobile device 1100. As shown in FIG. 11, a mobile operating system 1170 (e.g., iOS, Android, Windows Phone, etc.), and one or more applications 1180 may be loaded into memory 1160 from storage 1190 in order to be executed by the CPU 1140. The applications 1180 may include a user interface or any other suitable mobile apps for information analytics and management according to the present teaching on, at least partially, the mobile device 1100. User interactions, if any, may be achieved via the I/O devices 1150 and provided to the various components connected via network(s).

To implement various modules, units, and their functionalities described in the present disclosure, computer hardware platforms may be used as the hardware platform(s) for one or more of the elements described herein. The hardware elements, operating systems and programming languages of such computers are conventional in nature, and it is presumed that those skilled in the art are adequately familiar therewith to adapt those technologies to appropriate settings as described herein. A computer with user interface elements may be used to implement a personal computer (PC) or other type of workstation or terminal device, although a computer may also act as a server if appropriately programmed. It is believed that those skilled in the art are familiar with the structure, programming, and general operation of such computer equipment and as a result the drawings should be self-explanatory.

Figure 12:
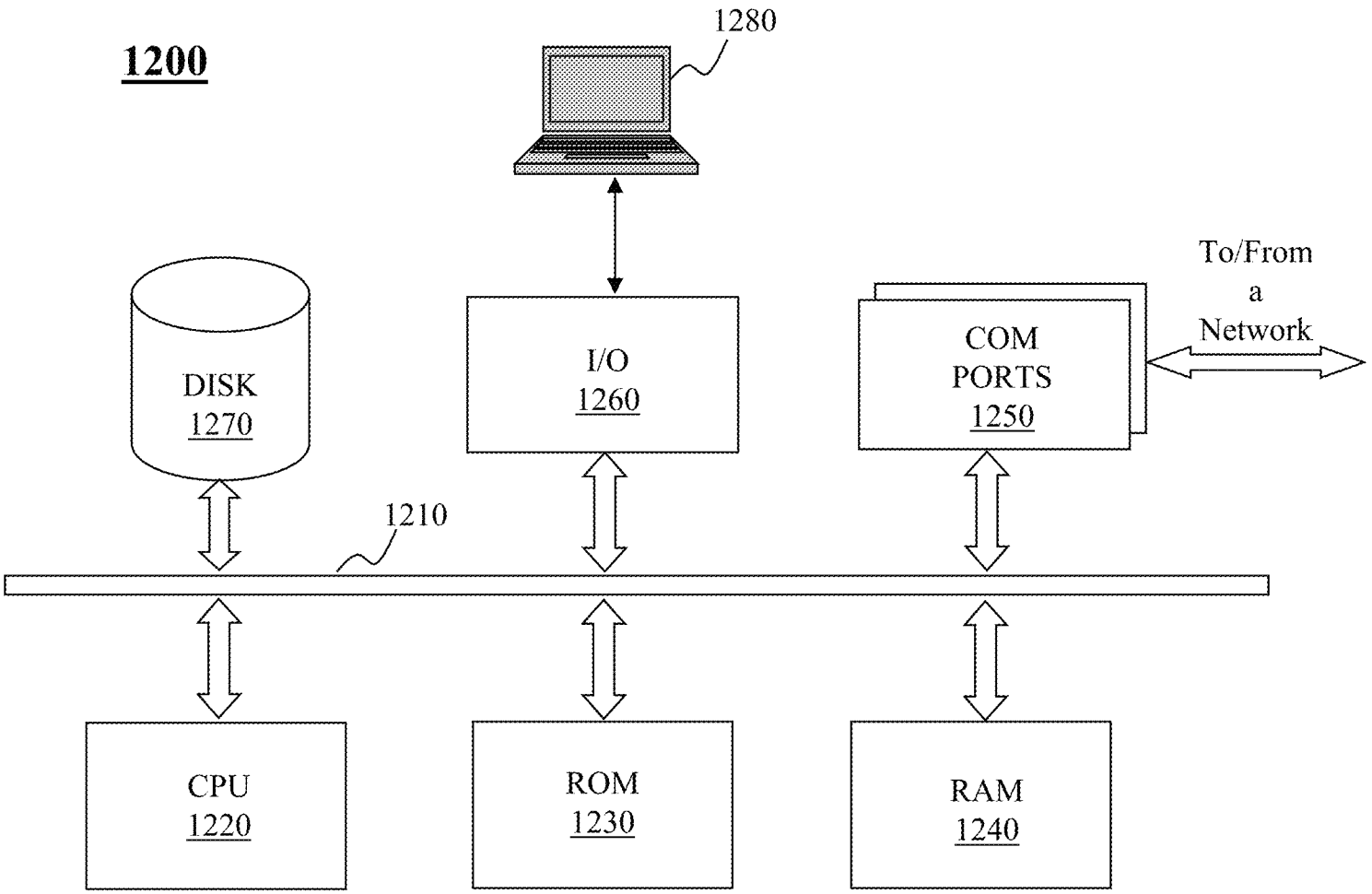
FIG. 12 is an illustrative diagram of an exemplary computing device architecture that may be used to realize a specialized system implementing the present teaching in accordance with various embodiments.

FIG. 12 is an illustrative diagram of an exemplary computing device architecture that may be used to realize a specialized system implementing the present teaching in accordance with various embodiments. Such a specialized system incorporating the present teaching has a functional block diagram illustration of a hardware platform, which includes user interface elements. The computer may be a general-purpose computer or a special purpose computer. Both can be used to implement a specialized system for the present teaching. This computer 1200 may be used to implement any component or aspect of the framework as disclosed herein. For example, the information analytical and management method and system as disclosed herein may be implemented on a computer such as computer 1200, via its hardware, software program, firmware, or a combination thereof. Although only one such computer is shown, for convenience, the computer functions relating to the present teaching as described herein may be implemented in a distributed fashion on a number of similar platforms, to distribute the processing load.

Computer 1200, for example, includes COM ports 1250 connected to and from a network connected thereto to facilitate data communications. Computer 1200 also includes a central processing unit (CPU) 1220, in the form of one or more processors, for executing program instructions. The exemplary computer platform includes an internal communication bus 1210, program storage and data storage of different forms (e.g., disk 1270, read only memory (ROM) 1230, or random-access memory (RAM) 1240), for various data files to be processed and/or communicated by computer 1200, as well as possibly program instructions to be executed by CPU 1220. Computer 1200 also includes an I/O component 1260, supporting input/output flows between the computer and other components therein such as user interface elements 880. Computer 1200 may also receive programming and data via network communications.

Hence, aspects of the methods of dialogue management and/or other processes, as outlined above, may be embodied in programming. Program aspects of the technology may be thought of as "products" or "articles of manufacture" typically in the form of executable code and/or associated data that is carried on or embodied in a type of machine readable medium. Tangible non-transitory "storage" type media include any or all of the memory or other storage for the computers, processors or the like, or associated modules thereof, such as various semiconductor memories, tape drives, disk drives and the like, which may provide storage at any time for the software programming.

All or portions of the software may at times be communicated through a network such as the Internet or various other telecommunication networks. Such communications, for example, may enable loading of the software from one computer or processor into another, for example, in connection with information analytics and management. Thus, another type of media that may bear the software elements includes optical, electrical, and electromagnetic waves, such as used across physical interfaces between local devices, through wired and optical landline networks and over various air-links. The physical elements that carry such waves, such as wired or wireless links, optical links, or the like, also may be considered as media bearing the software. As used herein, unless restricted to tangible "storage" media, terms such as computer or machine "readable medium" refer to any medium that participates in providing instructions to a processor for execution.

Hence, a machine-readable medium may take many forms, including but not limited to, a tangible storage medium, a carrier wave medium or physical transmission medium. Non-volatile storage media include, for example, optical or magnetic disks, such as any of the storage devices in any computer(s) or the like, which may be used to implement the system or any of its components as shown in the drawings. Volatile storage media include dynamic memory, such as a main memory of such a computer platform. Tangible transmission media include coaxial cables; copper wire and fiber optics, including the wires that form a bus within a computer system. Carrier-wave transmission media may take the form of electric or electromagnetic signals, or acoustic or light waves such as those generated during radio frequency (RF) and infrared (IR) data communications. Common forms of computer-readable media therefore include for example: a floppy disk, a flexible disk, hard disk, magnetic tape, any other magnetic medium, a CD-ROM, DVD or DVD-ROM, any other optical medium, punch cards paper tape, any other physical storage medium with patterns of holes, a RAM, a PROM and EPROM, a FLASH-EPROM, any other memory chip or cartridge, a carrier wave transporting data or instructions, cables or links transporting such a carrier wave, or any other medium from which a computer may read programming code and/or data. Many of these forms of computer readable media may be involved in carrying one or more sequences of one or more instructions to a physical processor for execution.

Those skilled in the art will recognize that the present teachings are amenable to a variety of modifications and/or enhancements. For example, although the implementation of various components described above may be embodied in a hardware device, it may also be implemented as a software only solution—e.g., an installation on an existing server. In addition, the techniques as disclosed herein may be implemented as a firmware, firmware/software combination, firmware/hardware combination, or a hardware/firmware/software combination.

While the foregoing has described what are considered to constitute the present teachings and/or other examples, it is understood that various modifications may be made thereto and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

I claim:

1. A system, comprising:

a synchronization timing instruction generator implemented by a processor and configured for receiving a stroke rate from a coxswain, and generating a synchronization timing instruction with a plurality of timings according to a duration corresponding to a stroke cycle determined based on the stroke rate, wherein the plurality of timings in the duration specify respective time instances for a plurality of events to occur;

a communication unit implemented by a processor and configured for transmitting the synchronization timing instruction to multiple rower units associated with respective multiple rowers;

a rower sensor initializer implemented by a processor and configured for initializing each of the multiple rower units at the start of the stroke cycle;

a real-time sensor data processor implemented by a processor and configured for:

receiving, from a plurality of sensors associated with each of the multiple rowers, sensor data, and processing the sensor data to determine actual timings of the plurality of events; and a synchronization signaling generator implemented by a processor and configured for:

determining a synchronization status for each of the plurality of events associated with each of the multiple rowers, generating an alert signal indicative of synchronization performance associated with each of the plurality of events with respect to each of the multiple rowers based on the synchronization timing instruction and the actual timing for the event associated with the rower, and transmitting the alert signals to the multiple rower units reporting the synchronization performance on the plurality of events with respect to the multiple rowers.

2. The system of claim 1, wherein the plurality of events associated with each of the multiple rowers in each stroke cycle includes at least one of:

a first event when an oar held by the rower passes the knee of the rower;

a second event when the oar passes an ankle of the rower;

a third event when the oar enters water; and a fourth event when the oar leaves the water.

3. The system of claim 2, wherein the plurality of timings includes sequentially arranged time instances for synchronizing the first, the second, the third, and the fourth events.

4. The system of claim 1, wherein the synchronization status associated with each of the plurality of events is one of a "sync" state, an "ahead" state, and a "behind" state.

5. The system of claim 4, wherein a synchronization status associated with one of the plurality of events is determined by:

generating the "sync" state when the actual timing is the same as a corresponding timing specified in the synchronization timing instruction;

generating the "ahead" state when the actual timing is before the corresponding timing specified in the synchronization timing instruction; and generating the 'behind" state when the actual time is after the corresponding timing specified in the synchronization timing instruction.

6. The system of claim 1, wherein the synchronization status with respect to each of the plurality of events is alerted to each of the multiple rower via at least one of:

sound; and vibration.

7. The system of claim 1, further comprising:

a performance data analyzer implemented by a processor and configured for:

tracking performance of each of the multiple rowers based on synchronization statuses associated with the rower on the plurality of events in different stroke cycles, and determining performance data with respect to each of the multiple rowers with regard to rowing synchronization, and archiving the performance data with respect to each of the multiple rowers in a performance data archive.

8. The system of claim 7, further comprising a personal feedback data generator implemented by a processor and configured for:

retrieving performance data associated with the rower;

generating personal feedback data specific to the rower based on the performance data associated with the rower; and providing the rower the personal feedback data specific to the rower.

9. The system of claim 8, further comprising a personalized practice guide generator implemented by a processor and configured for:

analyzing personal feedback data specific to one of the multiple rowers to generate an analysis result;

generating a personal practice guide for the rower based on the analysis result based on a data-driven practice guide; and sending, via the communication unit, the personal practice guide to the rower as a practice guide to assist the rower to practice rowing to enhance performance.

10. The system of claim 1, wherein each of the multiple rower units associated with a corresponding rower comprises:

a synchronization signaling receiver implemented by a processor and configured for receiving synchronization related signals from the central unit; and a delivery synchronization signaling controller implemented by a processor and configured for delivering the received synchronization related signals from the central unit to the corresponding rower.

11. The system of claim 10, wherein the synchronization related signals include:

the synchronization timing instruction; and synchronization statuses associated with the plurality of synchronization events.

12. The system of claim 10, further comprising:

a synchronization signaling determiner implemented by a processor and configured for setting up preferred means to communicating a synchronization signal from the central unit to the rower; and a storage for archiving the preferred means for delivering synchronization related signals for the delivery synchronization signaling controller to deliver signals to the rower in a personalized manner.

13. The system of claim 10, further comprising:

an interface unit implemented by a processor and configured for facilitating communication with the rower.

14. The system of claim 13, wherein the communication with the rower includes:

interactions with the rower to set up preferred signaling means to deliver synchronization signals; and channeling interactions between the rower and the central unit for:

retrieving personal feedback data specific to the rower on past performance of the rower with respect to synchronization, requesting an analysis on the personal feedback data specific to the rower, or obtaining a personalized practice guide from the central unit generated based on an analysis of the personal feedback data specific to the rower.

15. The system of claim 1, wherein the plurality of sensors associated with each of the multiple rowers includes:

a first sensor is for detecting an actual timing when the oar passes the knee of a rower;

a second sensor is for detecting an actual timing when the oar passes the ankle of a rower;

a third sensor is for detecting an actual timing when an oar enters the water; and a fourth sensor is for detecting an actual timing when an oar leaves the water.

16. The system of claim 15, wherein the first and the second sensor is one of a laser distance sensor, a visual sensor, and a motion sensor;

the third and the fourth sensor corresponds to an oarlock sensor.

17. The system of claim 16, wherein the oar sensor provides further information which includes:

angles of an oar when entering and leaving the water;

power of stroke determined based on a force a rower applies to an oar;

slip indicative of water resistance during a stroke;

wash representing an amount of water displaced when an oar leaves water;

effective length indicative of total degrees traversed by an oarlock;

a maximum/peak force;

a peak force angle at a peak force; and work per stroke which measures the effectiveness of each stroke.

* * * * *